US007614581B2

(12) United States Patent
Beem et al.

(10) Patent No.: US 7,614,581 B2
(45) Date of Patent: Nov. 10, 2009

(54) FENCING HANDLER

(76) Inventors: Mark V. Beem, 861 N. Green Rd., Lake City, MI (US) 49651; Alan L. Diemer, 9970 S. 8 Mile Rd., McBain, MI (US) 49657

( * ) Notice: Subject to any disclaimer, the term of this patent is extended or adjusted under 35 U.S.C. 154(b) by 96 days.

(21) Appl. No.: 11/775,275

(22) Filed: Jul. 10, 2007

(65) Prior Publication Data

US 2009/0014578 A1 Jan. 15, 2009

(51) Int. Cl.
*B65H 16/02* (2006.01)

(52) U.S. Cl. ..... 242/557; 242/403; 242/419.4; 242/419.5; 242/533.8

(58) Field of Classification Search ..... 242/403, 242/397.5, 419.4–419.5, 557, 533.8; 414/911
See application file for complete search history.

(56) References Cited

U.S. PATENT DOCUMENTS 4,930,718 A * 6/1990 Lancour et al. ..... 242/557
5,163,634 A * 11/1992 Moon et al. ..... 242/419
5,582,216 A * 12/1996 Smith et al. ..... 140/107
5,806,779 A 9/1998 Crum
7,143,971 B2 12/2006 Yoder
7,195,193 B2 * 3/2007 Capps ..... 242/396.5
2004/0227031 A1 * 11/2004 Yoder et al. ..... 242/390.5
2005/0133776 A1 * 6/2005 Capps ..... 256/32
2007/0210200 A1 * 9/2007 Popp ..... 242/419.4

OTHER PUBLICATIONS

Photographs 1 & 2 of a fence dispensing apparatus used at least as early as Jul. 10, 2006.

* cited by examiner

*Primary Examiner*—Sang Kim
(74) *Attorney, Agent, or Firm*—James E Bartek

(57) ABSTRACT

A fencing handler has a foundation, a spool post connected with the foundation and tiltable between two sides of the foundation. A tilt arm hinges about an arm pivot and relative to the foundation, between folded and tilted positions. An actuator connects between a first tilt arm end and the foundation to rotate the tilt arm. A tilt plate releasably connects with the foundation and hinges with the tilt arm. A toggle pivots relative to the tilt plate to alternatively capture a tilt arm second end is between the toggle and the tilt plate and release the arm.

31 Claims, 21 Drawing Sheets

50
100
600
214
200
308
60
300

FENCING HANDLER

CROSS-REFERENCE TO RELATED APPLICATIONS

Not Applicable.

BACKGROUND OF THE INVENTION

The invention relates to fencing installation and more particularly to a tool that is directed to deployment, tensioning, and installation of rolled fence material or fabric, namely, a fence handler.

Some fencing materials are commonly sourced as rolls of wire or rolled fencing fabric. The fabric varieties of fencing material may commonly include wire or plastic constructions and the like and may include constructions that are woven, tied, and molded. One commonly known variety of rolled fence fabric is commonly known as "chain link" or "cyclone" fencing, for example.

In the installation of fencing materials, one may typically install an array of fence posts as desired and commonly known. One would then fasten preselected fence material to the installed fence posts as is also commonly known. In the process of attachment, the fence material is typically dispensed by laying it along the fence posts. The fence material is then erected, especially in the case of a fabric material, by standing the fence material against the posts so that the material is in, or at least close to, its final installed position. So positioned, the fence material is fastened to the posts in various and commonly known methods.

A proper fence installation further includes tensioning or stretching the fence material so that it does not sag or otherwise deflect between the posts. While this may to some extent be considered an esthetic consideration, there are also functional benefits to a properly tensioned fence. Deflection of a fence material between posts diminishes fence security and provides a weakened fence, for example. Such a loose fence installation may also lead to lateral deflection, weakening, damage, and breaking of not only the fence material, but also the fence posts, which support the slack fence. Thus, a need for a well tensioned fence may be seen, and preferably, a tool to properly tension a fence. Yet, traditional methods of fence tensioning remain awkward at best and typically involve fastening a first end of a portion or length of fence material to a post and then pulling an opposite end of the material portion with winch, perhaps a "come-along," or by several workers.

Further, when a long run or length of fence is installed or when tall fencing is installed, or both, long lengths of tall fencing, the rolls of fencing material may quickly become bulky, heavy, and otherwise cumbersome to handle. Thus, a need for a tool to handle the fence material in installation may also be seen.

BRIEF SUMMARY OF THE INVENTION

Accordingly, a fencing handler of the invention overcomes prior failings and fulfills the above desires. More particularly, the present inventive tool provides mechanized handling of fencing materials, including acquiring a roll of material, either singularly or from a supply of multiple rolls, placement of the fence material near to its final installed position along installed fence posts, and tensioning of the fence in place so that the fence material may be simply and properly attached to the posts.

The present inventive fencing handler, has a foundation with a spool post connected with the foundation such that the post is tiltable between two sides of the foundation to acquire fence material or to off load unused material. The post may also be positioned to stand and extend upward or generally perpendicular to the foundation. A tilt arm is hingedly connected with the foundation, between the post and the foundation, and hinges between a folded position and a tilted position. The tilt arm is also connect with the foundation by an arm pivot that has a pivot axis extending between opposite front and back ends of the foundation so that the tilt arm pivots about the arm pivot and toward one of the foundation left and right sides to its tilted position. An actuator is connected between the tilt arm, at a first end of the tilt arm, and the foundation. The actuator extends along the tilt arm and is adapted to rotate the tilt arm about the arm pivot between the folded and tilted positions.

In other aspects of the invention, the tilt arm may extend between opposing left and right sides of the foundation. The arm pivot may be connected with the tilt arm between opposite first and second ends of the tilt arm. Further, a tilt plate may releasably connect with the foundation and be adapted to hinge with the tilt arm between the folded and the tilted positions. A toggle may be pivotally connected with the tilt plate whereby the tilt arm second end is captured between the toggle and the tilt plate and alternatively released.

These and other features, objects, and benefits of the invention will be recognized by one having ordinary skill in the art and by those who practice the invention, from this disclosure, including the specification, the claims, and the drawing figures, among other elements.

DETAILED DESCRIPTION OF THE INVENTION

Figure 1:
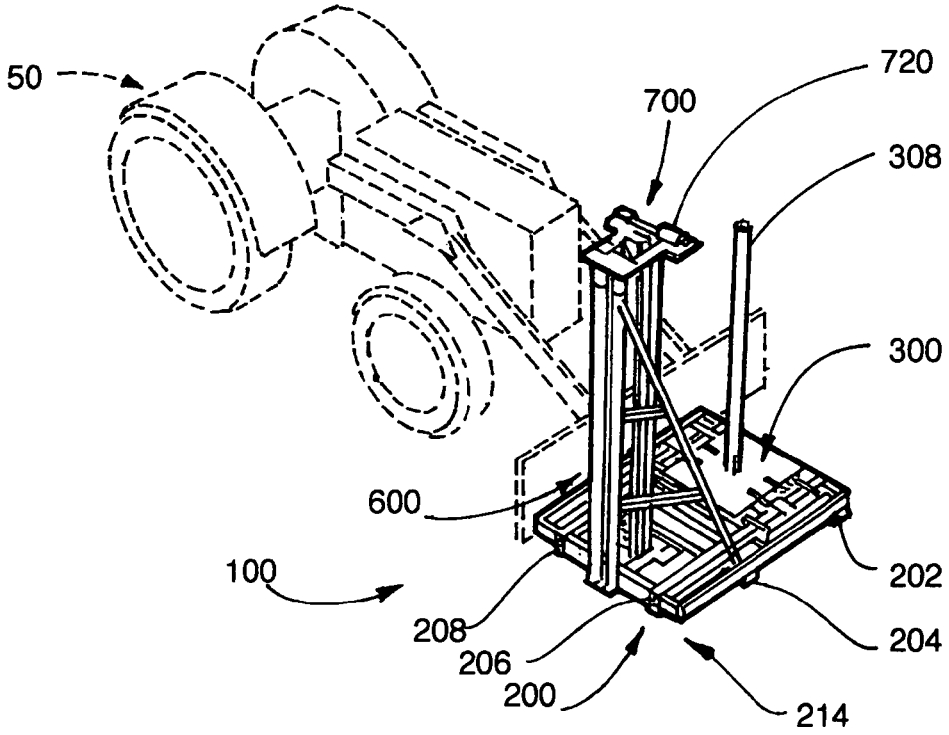
FIG. 1 is an upper front left perspective view of a fencing handler of the invention, showing in phantom a tractor to handle the tool with the tool oriented relative to the tractor to deploy fence to the right of the tractor.

A preferred embodiment of a fencing handler 100 according to the invention is generally shown in the drawing figures and discussed below. Some basic elements or subassemblies of the fencing handler 100 may be identified as a foundation 200, a slide 500, a tilt arm 400, a tilt table assembly 300, and an actuator 420. The exemplary embodiment 100 shown, also discloses a fencing guide tower 600 that may be provided at the front of the fencing handler foundation 200 and a fencing tensioning clamp 700 that is preferably located between the guide tower and the tilt table assembly.

Figure 2:
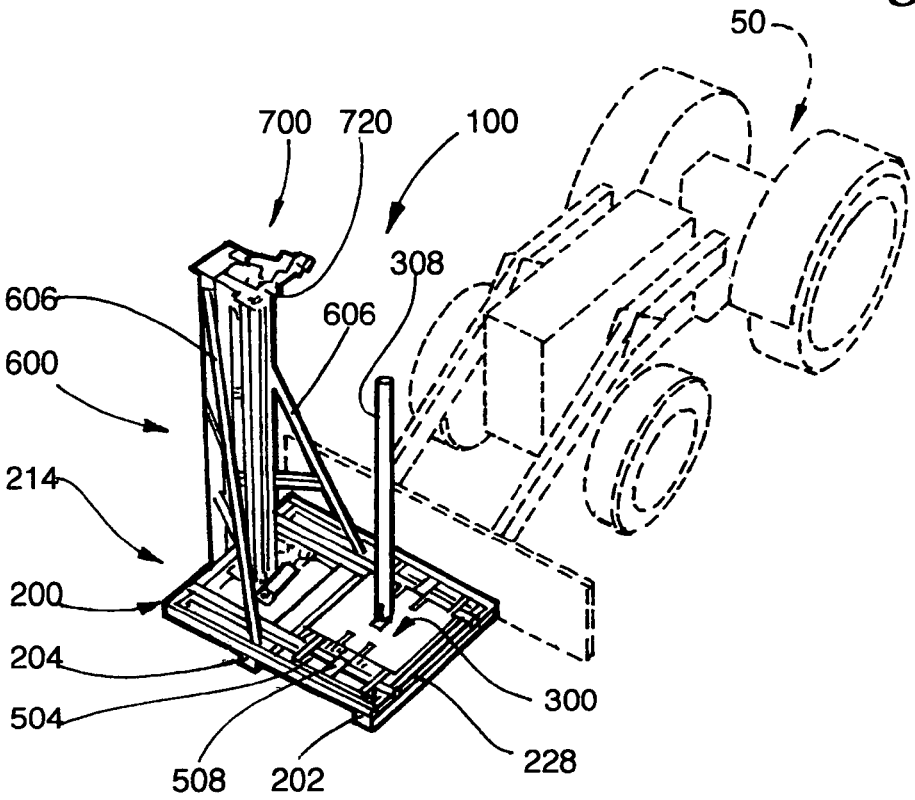
FIG. 2 is an upper back left perspective view thereof.
Figure 14:
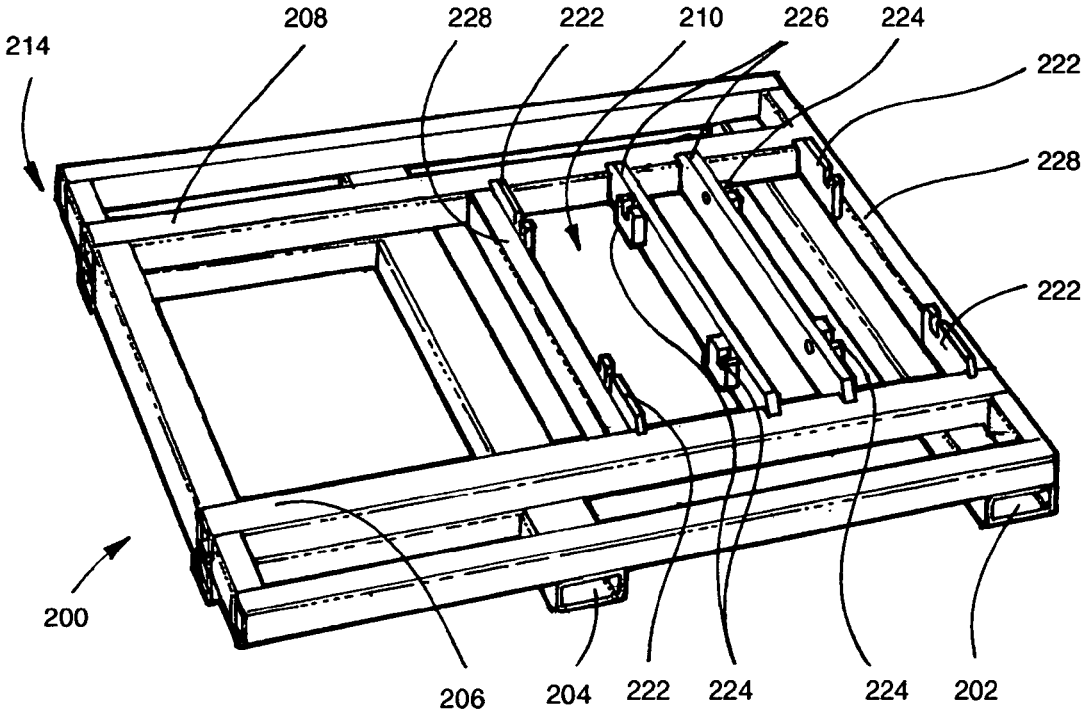
FIG. 14 is an upper front left perspective view of a foundation thereof.
Figure 15:
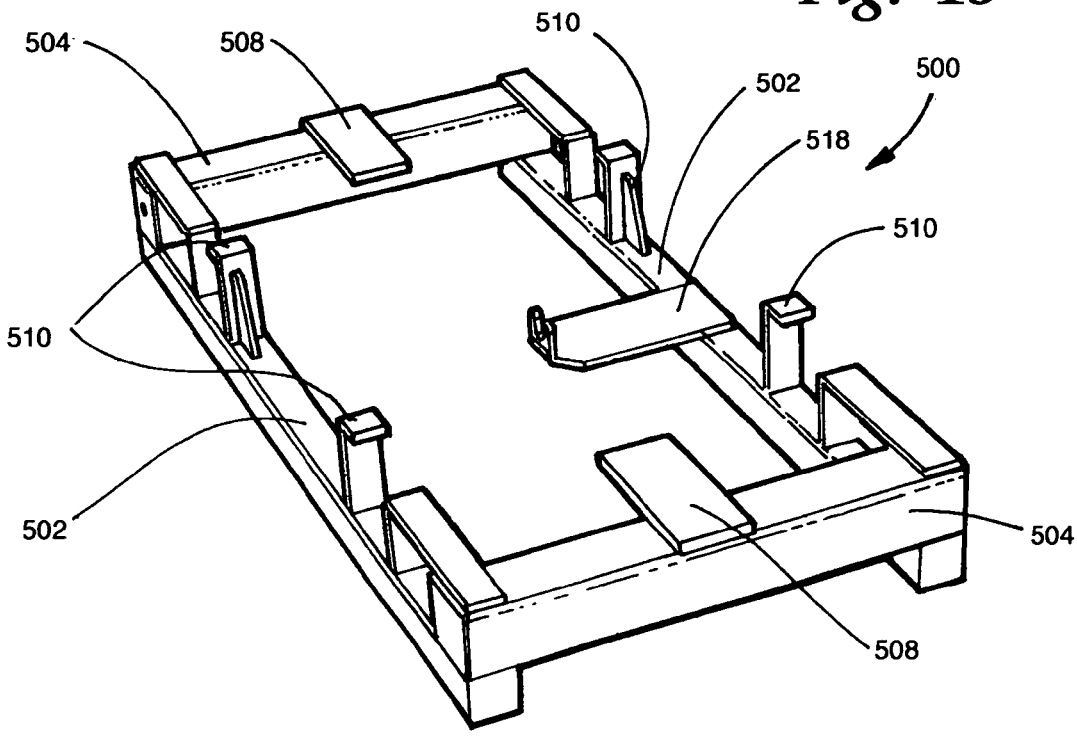
FIG. 15 is an upper front left perspective view of a slide frame thereof.
Figure 16:
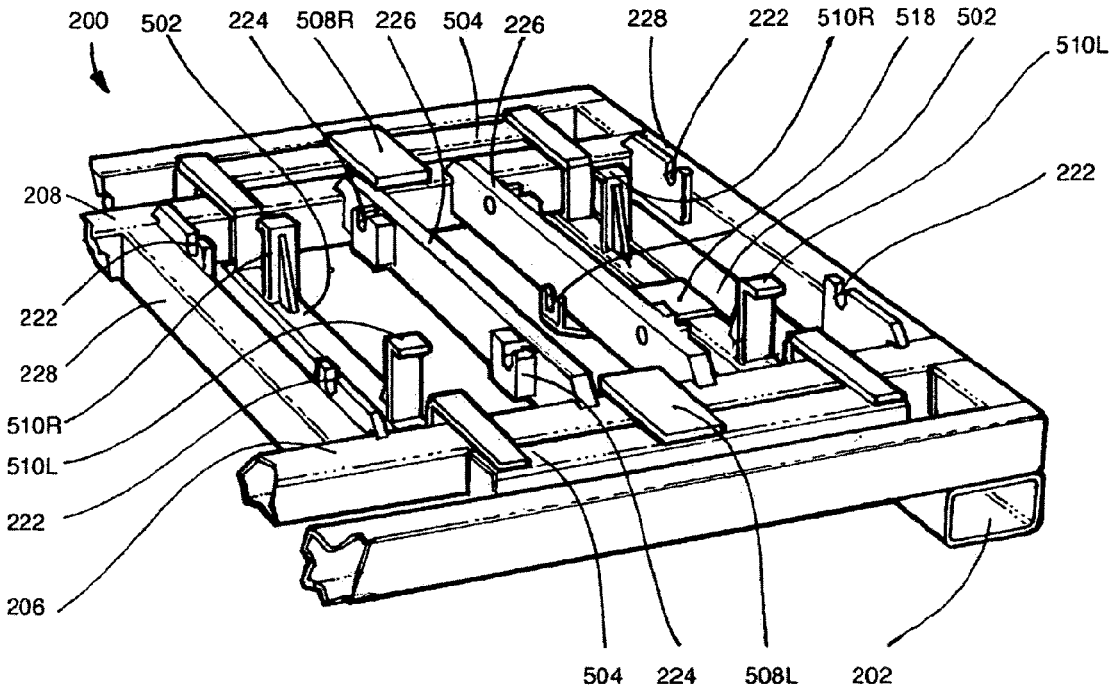
FIG. 16 is a fragmentary upper front left perspective view of the foundation, showing the slide frame installed therein.

The foundation 200 may conceptually be considered pallet-like (FIG. 14). In the example shown, the foundation is adapted to be coupled with commonly known load forks of a material handling tug 50, including farm tractors (FIGS. 1 and 2), timbering skids, skid steer material handlers (FIG. 2), and other material handling machines that may be equipped with load forks. One having ordinary skill in the art understands that the fencing handler 100 may alternatively be adapted to couple with various material handling machines with various couplers, including, a three point hitch. In the load fork coupling adaptation of the invention shown in the drawing figures, the fencing handler 100 is easily manipulated with load forks and may be lashed or otherwise secured to the respective tug as is known.

One having ordinary skill in the art further appreciates that the fence handler 100, including its various components, elements, and assemblies, may be constructed of various structural materials, in various configurations, and of various scale according to the preferences of a fabricator or user. Thus, this description is understood to be directed to the essence of the invention by reference to merely one exemplary embodiment, and recognizing at least basic mechanical aptitude of the one having ordinary skill in the art. As such, primary structure may be detailed regarding the exemplary embodiment, while common supporting or blocking elements may not be detailed. The supporting or blocking elements being understood by one having ordinary skill in the art.

Having said that, the foundation pallet 200 may comprise four primary defining elements, including a pair of 3×5×¼ inch (76.2×127×6.3 mm) mild steel, rectangular box beams 202 and 204 forming a base for the exemplary foundation 200 (FIG. 14). Although channels and other shapes as well as other materials may be used according to a fabricator's or user's preferences, the transverse back beam 202 and mid-beam 204 are convenient for use with conventional load forks. The back beam 202 preferably defines a back end of the foundation pallet 200 with the mid-beam 204 preferably being spaced from the back beam 202 to a position in a middle area of the foundation pallet.

Figure 13:
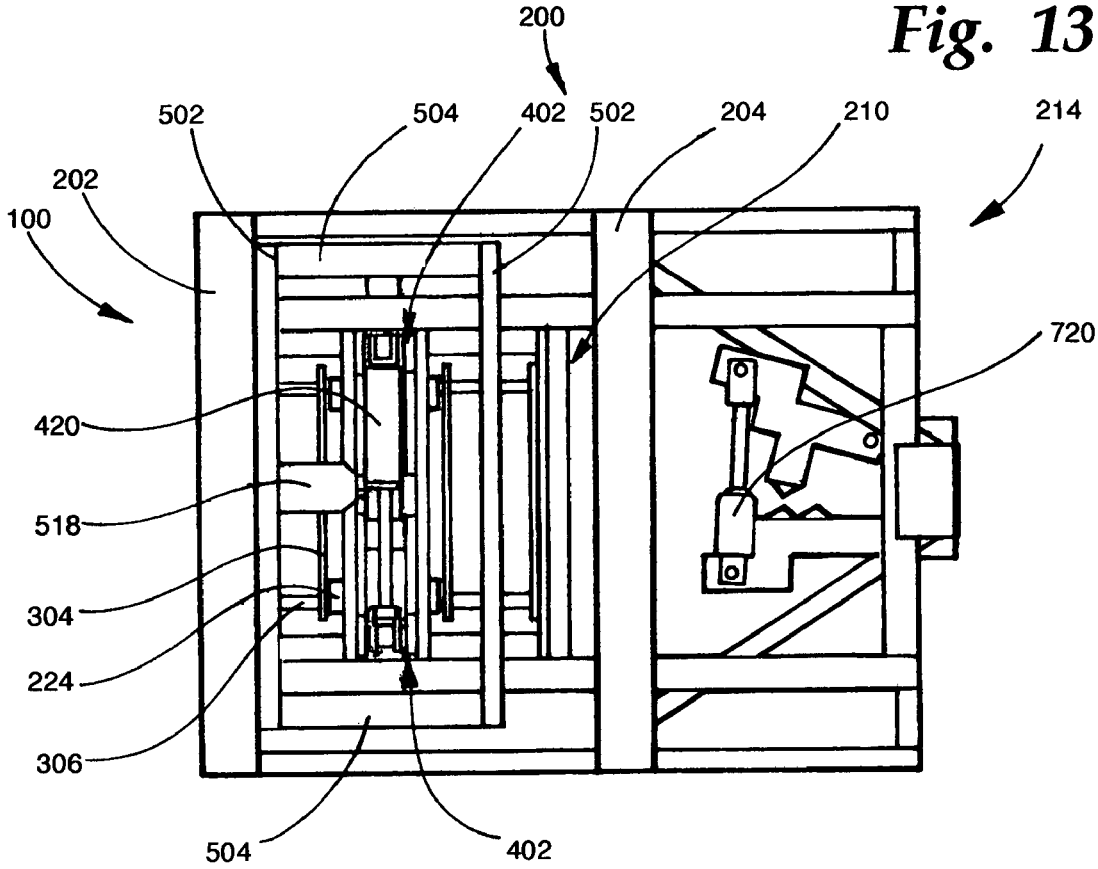
FIG. 13 is bottom plan view thereof.

A pair of 3×3×¼ inch (76.2×76.2×6.3 mm) mild steel, square box beams 206 and 208 may be mounted on top of the base beams 202 and 204 and extend along a length of the foundation from the back beam 202 (FIG. 14). The two transverse base beams 202 and 204 and the two longitudinal beams 206 and 208 are preferably perpendicular and may define a generally square included space 210 that may be sized about the same as a diameter of a roll of fencing material (FIG. 13). The longitudinal beams 206 and 208 may extend from the back beam 202 and beyond the mid-beam 204 to a front 214 of the pallet 200. This provides an offset of the fencing handler 100 so that fencing material that is being dispensed will preferably extend beyond a side of an associated material handling tug 50, as discussed above.

Figure 18:
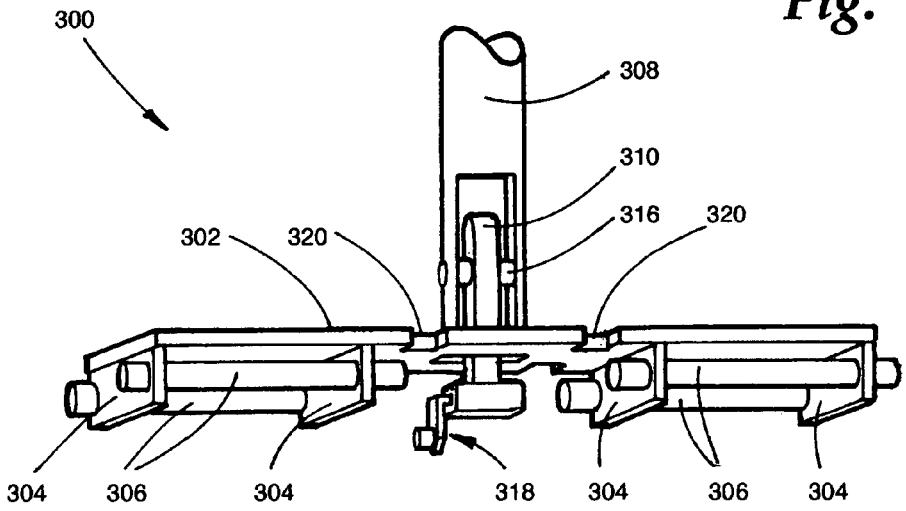
FIG. 18 is a lower right back perspective view of a tilt plate assembly of the inventive tool.
Figure 26:
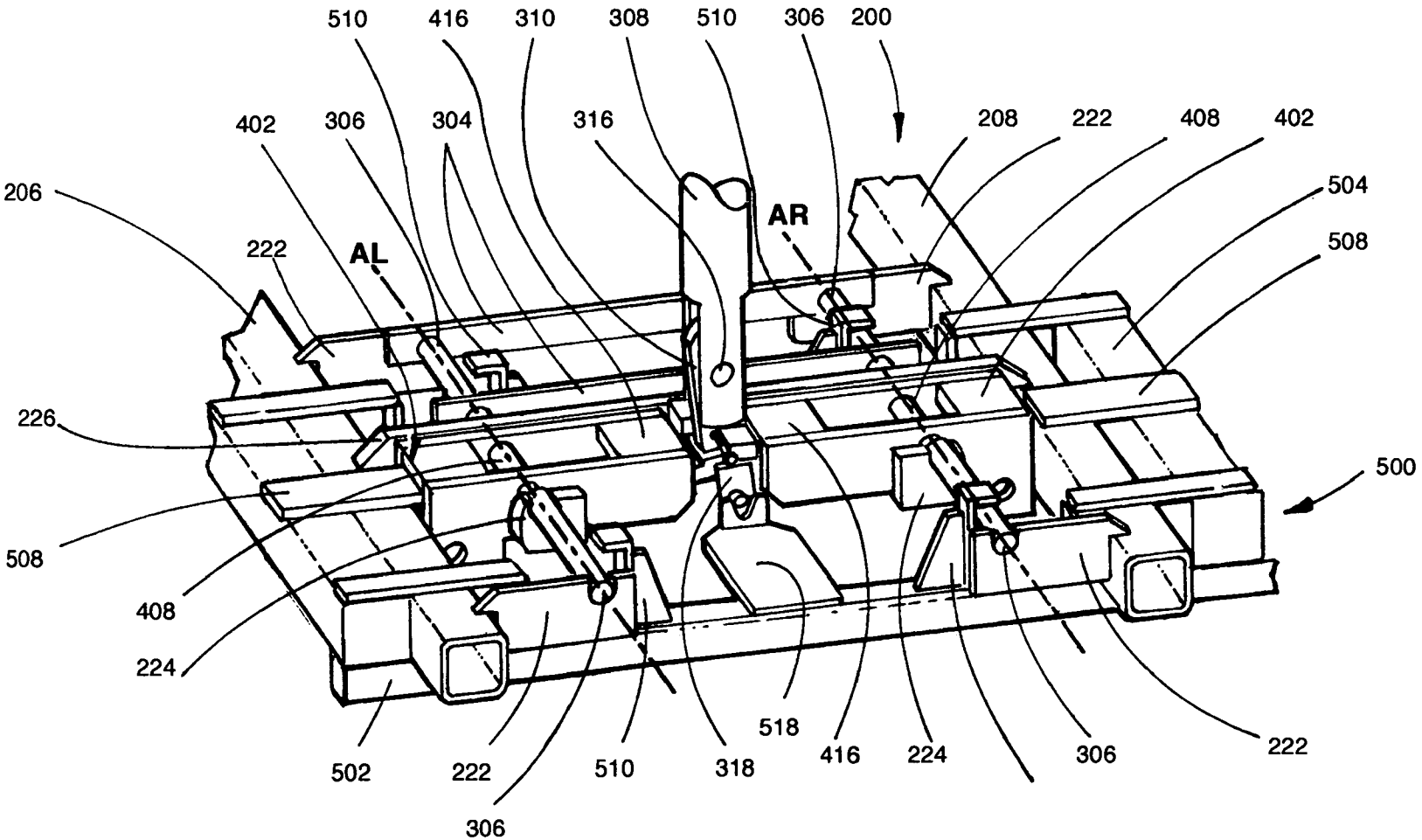
FIG. 26 is a fragmentary upper left back perspective view, showing relationship of the foundation, of the slide frame in a right position in the view, and of the toggle.

Additional elements of the foundation 200 may include pivot seats 222 and 224 (FIG. 14) that cooperate with a tilt table assembly 300 that is discussed further below (FIG. 18). More specifically, as shown, pairs of transverse supports may include inner supports 226 and outer supports 228 that preferably extend between the longitudinal beams 206 and 208, specifically from the left beam 206 to the right beam 208, and are preferably located between the back beam 202 and the mid beam 204 (FIG. 14). The pivot seats are preferably supported in alignment along one of two pivot axes, namely, a left tilt table pivot axis "AL" and a right tilt table pivot axis "AR" (FIG. 26).

Each pivot seat 222 and 224 is shown to provide a generally U-shaped bearing surface into which a corresponding pivot axle 306 of the tilt table assembly 300 may be removably seated (FIG. 18). The outer pivot seats 222 are conveniently mounted to the outer supports 228 that may be provided as transverse blocking that extends between the longitudinal beams 206 and 208 (FIG. 14). Relative to the scale of the transverse beams 202 and 204 and the longitudinal beams, the blocking or outer supports 228 may be sized as lengths of 2×3×¼ inch (50.8×76.2×6.3 mm) mild steel, rectangular tube. The outer pivot seats may be provided by short lengths, on the magnitude of about 6 inches (152.4 mm), of about 3 inch (76.2 mm) wide and half inch (12.7 mm) thick mild steel.

The inner pivot seats 224 may conveniently be mounted to inner supports 226, defining transverse pivot bars 226 that preferably extend between the longitudinal beams 206 and 208 (FIG. 14). Similar to the outer pivot seats 222, the transverse pivot bars 226 may be fabricated of lengths of about 3 inch (76.2 mm) wide and half inch (12.7 mm) thick mild steel. The inner pivot seats 224 may be provided by small blocks of mild steel about 2½ inches (63.5 mm) high, 3 inches (76.2 mm) long, and ¾ inch thick (19 mm).

Figure 32:
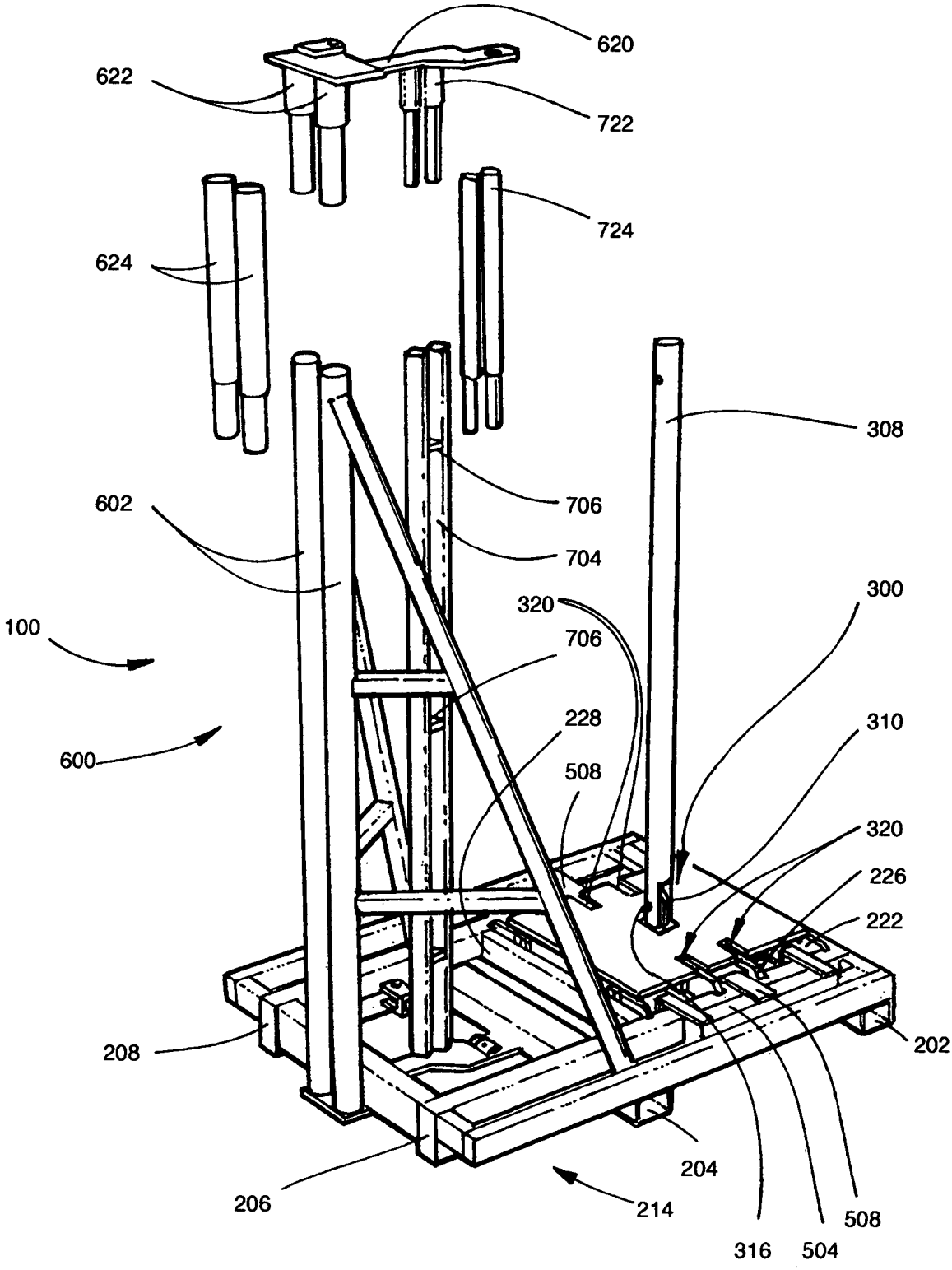
FIG. 32 is an exploded upper front left perspective view of a fencing handler of the invention with an optional extendable tower.

The tilt table assembly 300 merely sets in the pivot seats 222 and 224, and may comprise a tilt plate 302, rails 304, table pivots 306, a spool post 308, and a toggle 310 (FIG. 18). The plate 302 may be provided as a substantially square plate of mild steel that may substantially cover the included square space 210. The plate is preferably somewhat smaller than the included square space, however, to facilitate tipping of the plate between the outer pivot seats 222 and between the longitudinal beams 206 and 208. Tilt slots 320 are preferably provided into the left and right edges of the tilt plate 302 to clear the inner supports 226 when the tilt table assembly is tilted (FIGS. 18 and 32). Also, the plate may be constructed of whatever thickness and of whatever material desired, preferably taking into consideration wear of the plate as rolls of fencing material may rotate upon the plate as will be understood further in this description.

The rails 304 may be provided as lengths of about 1¾ inch (44.5 mm) wide and ⅜ inch (9.5 mm) thick mild steel that are mounted to a bottom of the tilt plate 302 and that extend in slip fit between the longitudinal beams 206 and 208. The pivots 306 may be provided as lengths of about 1 inch (25.4 mm) mild steel rod and are preferably secured in the rails with ends of the pivots extending beyond the rails so that the pivot ends will seat in the pivot seats 222 and 224. Thus, the U-shaped bearing surface defined in the pivot seats is preferably sized to accommodate slip fit engagement of the pivots.

The spool post 308 preferably is fastened with the tilt plate 302 and extends generally perpendicularly upward from the plate. The post may be sized however a user may desire. An about three to five foot (914-1,524 mm) length of 3 inch (76.2 mm) pipe may, for example, be useful for handling a roll of four foot (1,219.2 mm) high fencing material. A top end of the post may be rounded for ease of sliding the post into a center of a roll of fencing, while an opposite bottom end of the post, at the tilt plate, may be slotted or notched to facilitate pivoting of the toggle 310 as is further discussed below.

Figure 28:
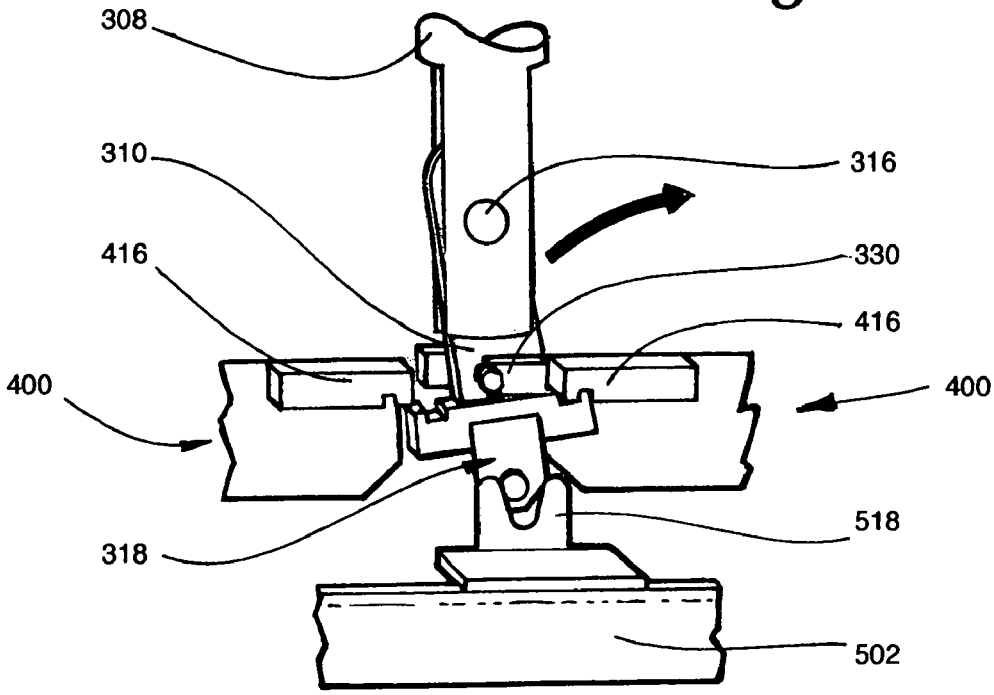
FIG. 28 is an enlarged detail thereof, showing interaction of the toggle with the slide frame and the tilt arms.
Figure 29:
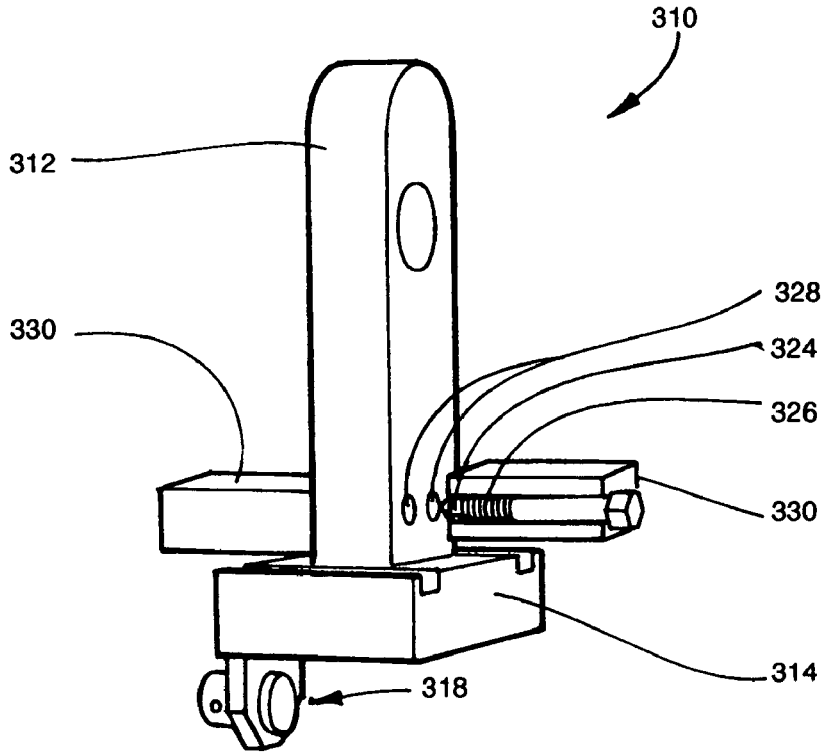
FIG. 29 is an enlarged view opposite to the view of FIG. 25 showing a detent mechanism of the toggle.

The toggle 310 is a generally T-shaped item with a stem portion 312 and a cross bar portion 314 as is generally known with T-shaped structures (FIGS. 18, 28 and 29). The toggle also has a finger or tail 318 that couples with a toggle switch 518 of the slide 500 so that positioning of the toggle may be controlled with positioning of the slide 500 as discussed further below. Again, as with other components, each of the stem and the cross bar may be fabricated of any structural material as desired. In the scale of the present example, the stem may be a length of about one inch (25.4 mm) wide and half inch (12.7 mm) thick mild steel and the cross bar may be a length of about 1½ inch (38.1 mm) wide and half inch (12.7 mm) thick mild steel. The toggle is mounted to pivot about a pivot 316 in an inverted orientation at a lower end of the post 308. More particularly, the toggle extends from the post and pivots selectively between the tilt levers 400, in a left-right direction relative to the foundation 200. Each end of the cross bar is configured with a catch hook 316 to cooperate with a catch block 416 of the tilt arms as is discussed further below (FIG. 28).

Figure 17:
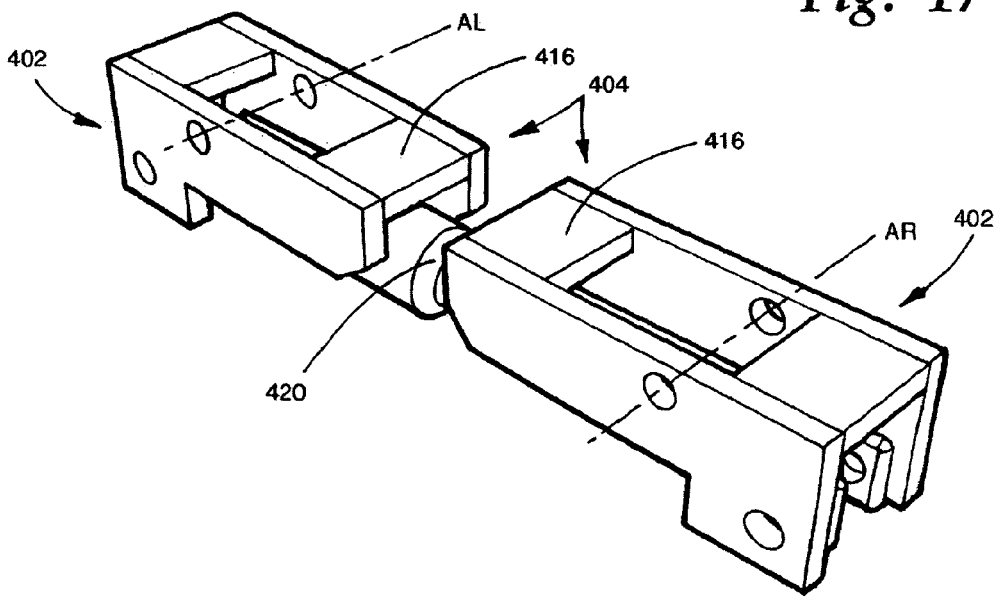
FIG. 17 is an upper front left perspective view of an assembly of a pair of tilt arms of the invention.
Figure 19:
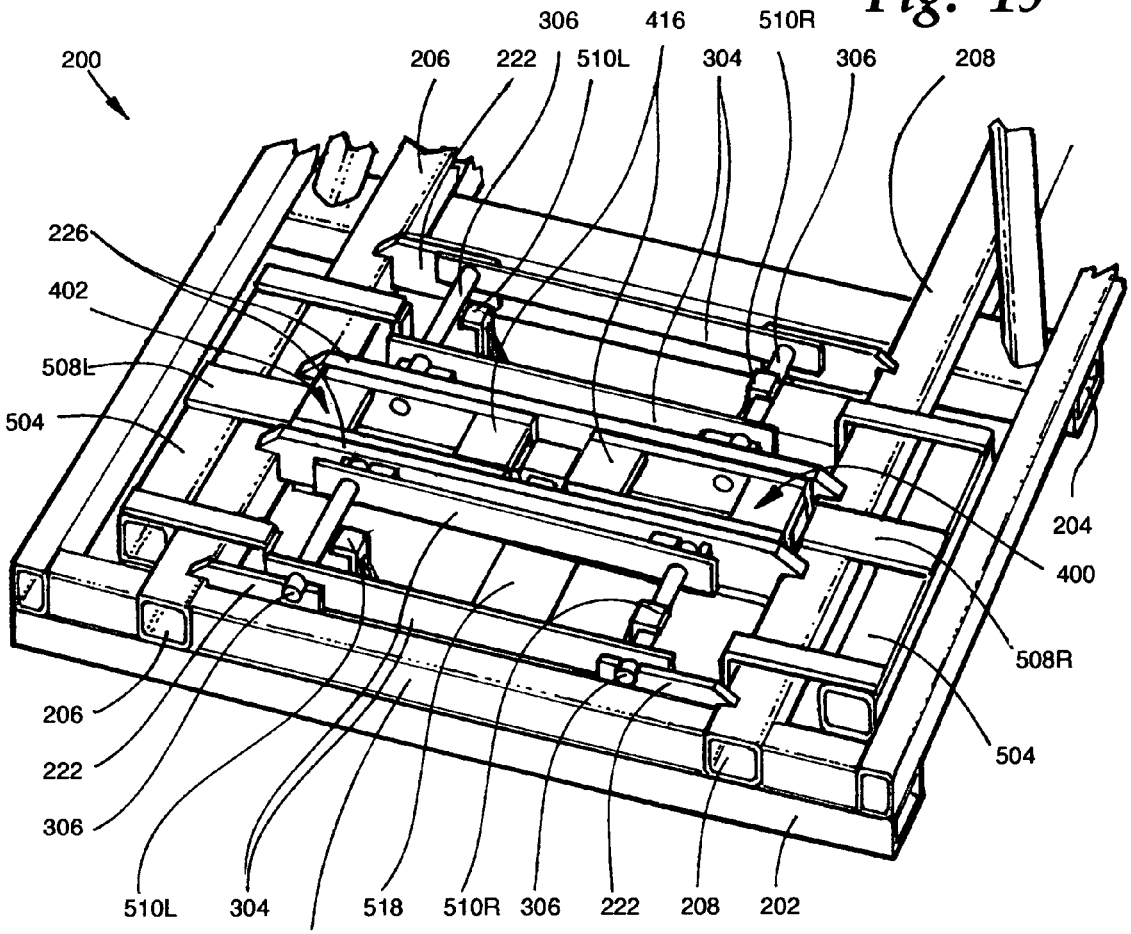
FIG. 19 is a fragmentary upper back right perspective view of the foundation, showing the slide frame assembly and the tilt arms installed in the foundation with the slide to its right position, and showing a pair of tilt plate pivots seated in the foundation.

Further to the foundation 200, a pair of tilt arms 400 are provided between the transverse pivot bars 226 (FIG. 19). More specifically, each tilt arm may be an open sided channel member and may alternatively be constructed as a welded up, for example, double L-shaped bracket of about ⅝ inch (15.9 mm) mild steel plate as shown (FIG. 17). Each tilt arm has a first end 402 and an opposite second end 404. When installed in the foundation 200, the first ends may be said to face outboard relative to the foundation and the second ends may be said to face inboard or one another. A tilt arm pivot 408 is provided between these opposite ends and positioned coaxial along axes "AL" and "AR" with the tilt plate pivots 306 (FIGS. 26 and 18).

Figure 20:
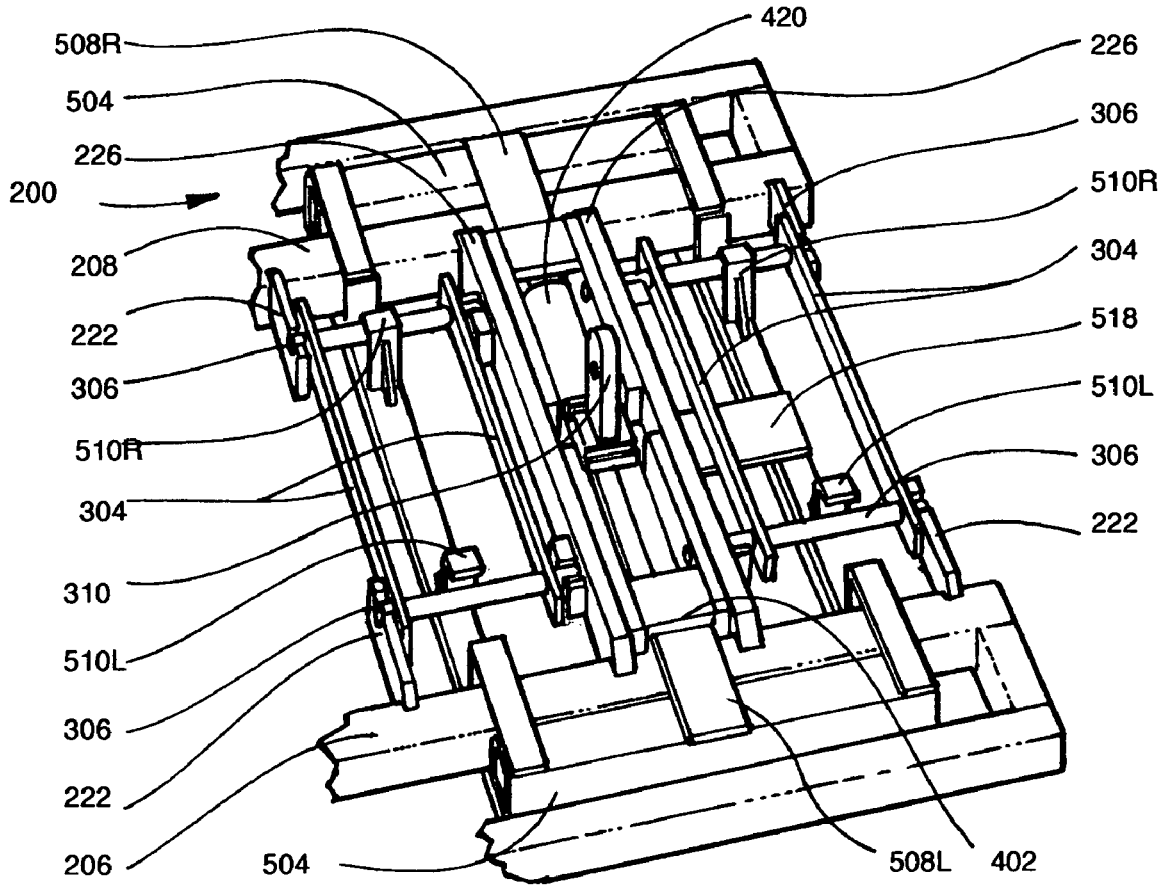
FIG. 20 is the view of FIG. 16 showing the slide frame assembly and the tilt arms installed in the foundation with the slide to its right position, and showing a tilt toggle, the tilt arms being fragmented to reveal the toggle.
Figure 21:
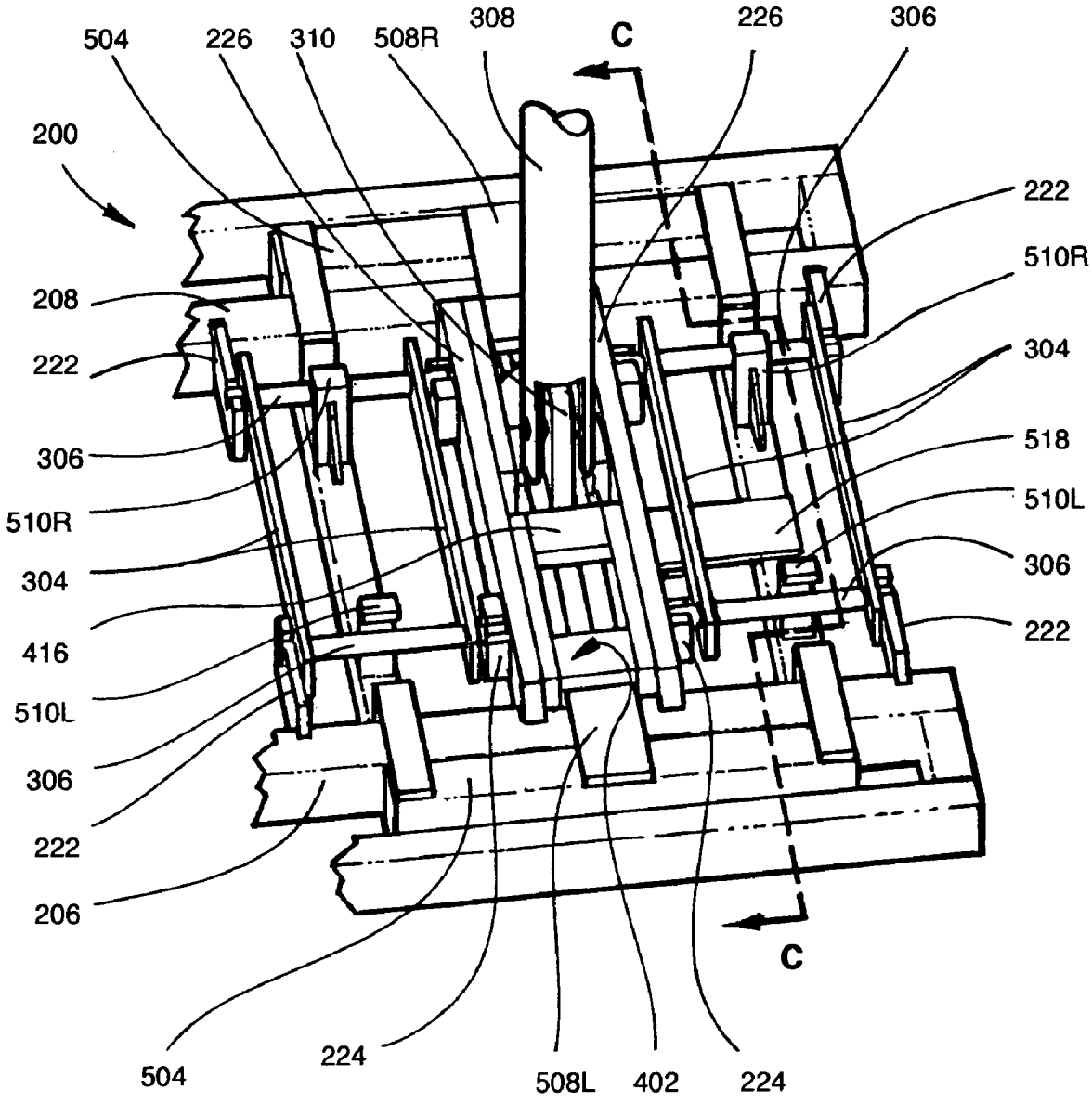
FIG. 21 is another view of FIG. 20 with the tilt arms not fragmented and including a spool post on the toggle.
Figure 27:
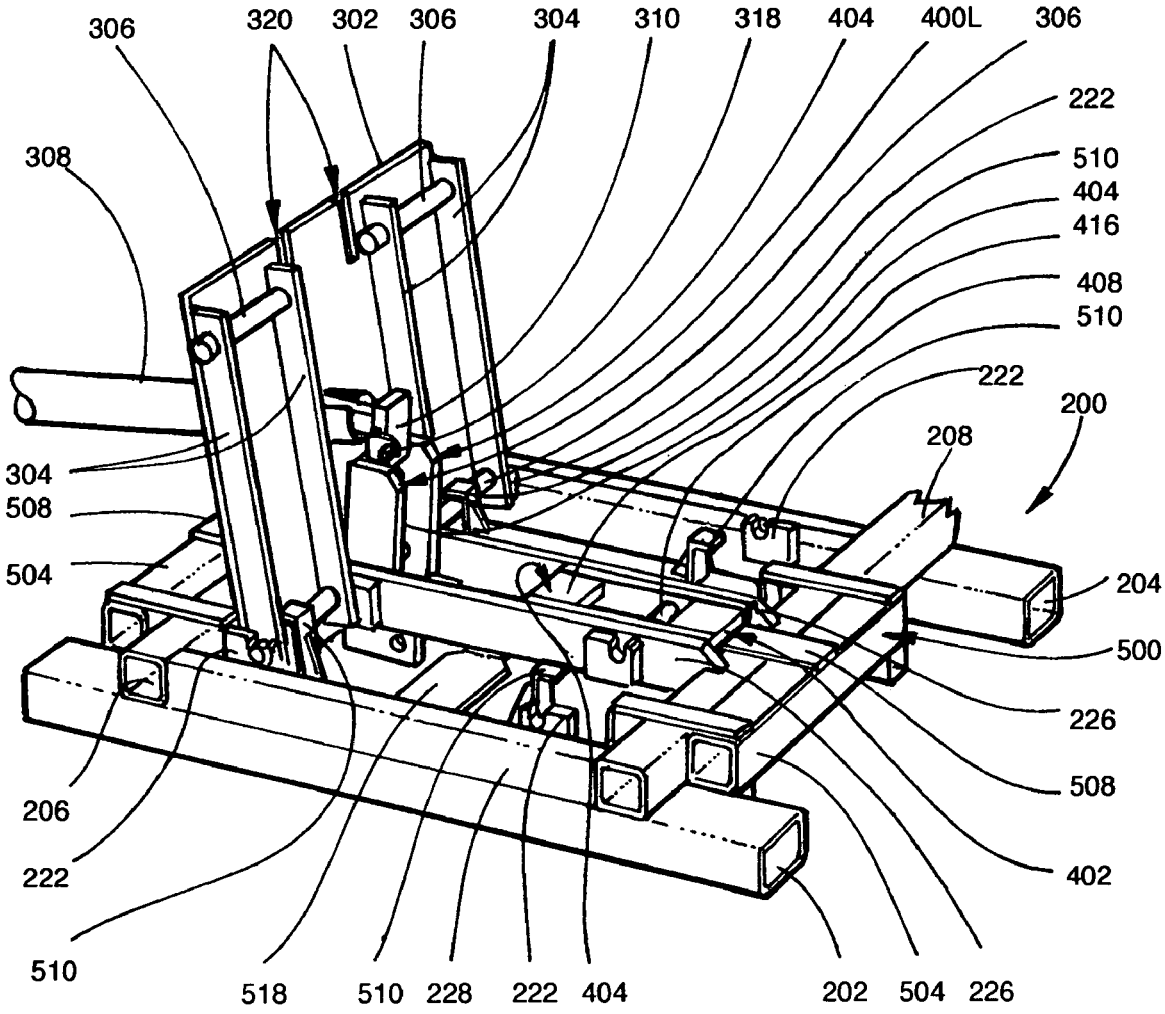
FIG. 27 is a fragmentary upper back right perspective view, showing the tilt table assembly tilted toward the left.

The tilt arms 400 are mounted on their respective tilt arm pivots 408 between the transverse pivot bars 226 in mirror image relation to one another (FIGS. 17 and 19-27) such that each tilt arm may pivot between a folded position as generally shown and a tilted position, seen in FIG. 27. The left tilt arm 400L is shown in its tilted position, being tilted toward the left of the pallet in FIG. 27. While an actuator may be provided for each tilt arm, a single actuator 420 is cleverly interconnected between the two tilt arms and may be pinned or otherwise pivotally connected near the first end 402 of each tilt arm to actuate the tilt arms in rotation about their respective pivots 408 between their respective folded and tilted positions (FIGS. 13, 17, and 20). The actuator may be any of various extendable mechanisms, including hydraulic cylinders, pneumatic cylinders, screw jacks, and rotating multiple link devices.

In the example of the embodiment shown in the drawing, the tilt actuator 420 includes a double acting hydraulic cylinder as understood by one having ordinary skill in the art. Arrangement is easily made to power this tilt actuator cylinder by connection with hydraulic power of the material handling tug 50 as is commonly known.

The slide 500 may be used to control selective actuation of the tilt arms 400 and to secure the tilt table assembly 300 with the foundation 200. A box frame of laterally extending front and back slide rails 502 and left and right end rails 504 may basically define the slide. A tilt stop 508 preferably extends inward from each end rail to selectively lock or release a respective tilt arm relative to its folded position. Pairs of hook structures 510 preferably extend upward from each slide rail 502 to define table pivot locks that selectively capture and release a respective tilt table assembly pivot 306. Further, the toggle switch 518 extends forward from the back slide rail and is adapted to engage the corresponding toggle tail 318 so that the toggle may be manipulated between left and right toggle positions with respective movement of the slide between its left and right positions (FIG. 28).

Figure 22:
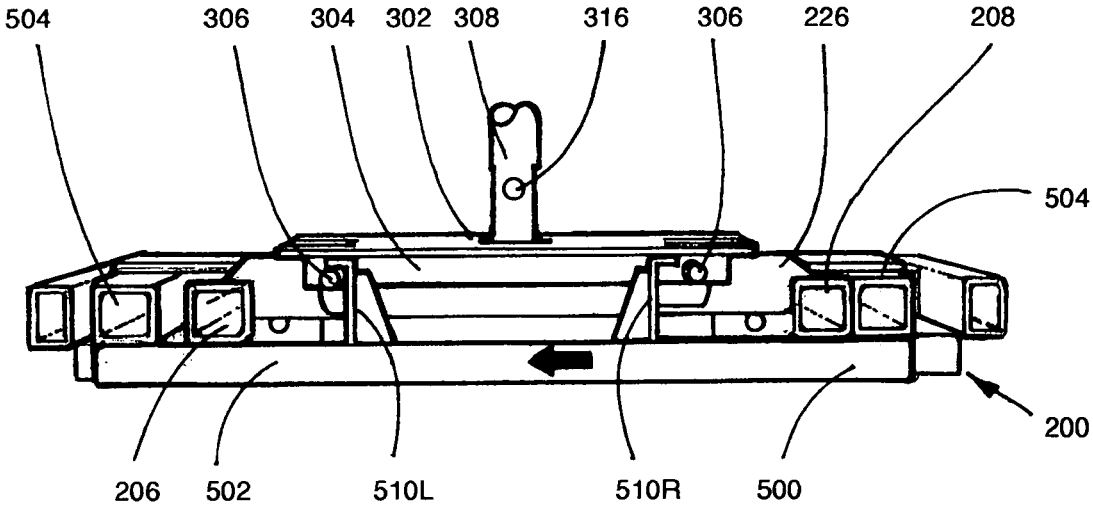
FIG. 22 is a fragmentary cross section view along line C-C of FIG. 21, showing the slide frame in a left position.
Figure 23:
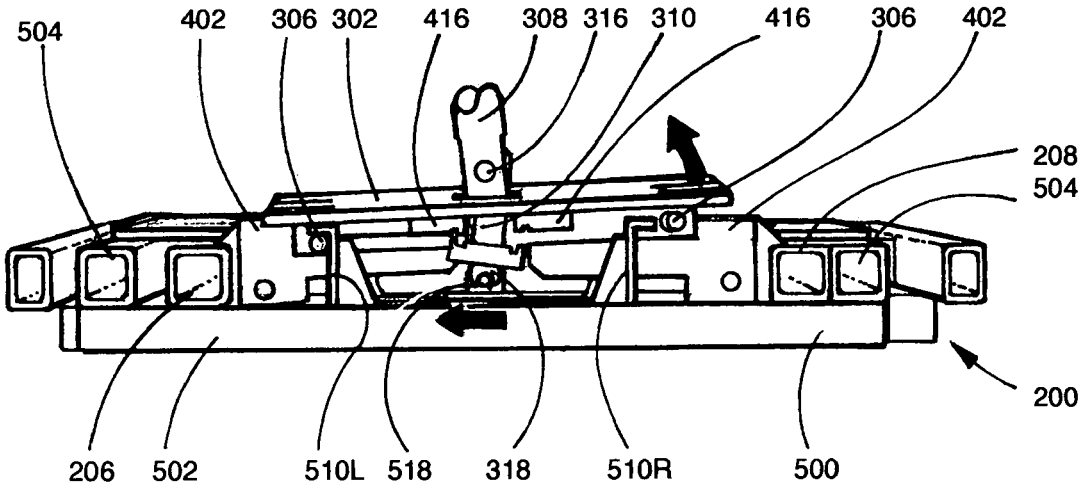
FIG. 23 is the view of FIG. 20 in further fragment, with the back inner support removed to show the toggle in a left position.

As is shown most clearly in the drawing FIGS. 22 and 23, the slide may be slid to its left position, in which the left hooks 510L capture and thereby lock the left table pivots 306 in their respective pivot seats 222 and 224 (FIG. 22). Concurrently, the right tilt stop 508R slides under the first end 402 of the right tilt arm 400R to prevent that tilt arm from rotating about its pivot 408 from its folded position to its tilted position. On the other hand, the right table pivots 306 are free to leave their respective pivot seats 222 and 224, and the left tilt stop 508L is clear of the left tilt arm 400L so that the left tilt arm is free to rotate about its pivot 408 from its folded position to its tilted position. Thus, with the slide in its left position, activation of the actuator 420 to draw together the respective first ends 402 of the left and the right tilt arms rotates the left tilt arm to its tilted position and the tilt table assembly 300 with it (FIG. 22).

It is important to note that when the slide is moved to its left position, selecting the left tilt arm for actuation as just discussed, the toggle switch 518 is engaged with the toggle tail 318 and manipulates the toggle to its left position so that the left toggle catch hook 316 engages a catch block 416 at the second end 404 of the left tilt arm 400L (FIG. 23). With the toggle positioned to its left position, the second end 404 of the left tilt arm is captured between the toggle 310 and the tilt table plate 302 such that the tilt table assembly 300 will not tip off from the tilt arm. Rather, the tilt table assembly is selectively captured by manipulation of the slide 500, to follow the tilting and folding of the tilt arm (FIG. 27). Of course, activation of the tilt actuator 420 to spread apart the respective first ends of the left and the right tilt arms rotates the left tilt arm to its folded position, and the tilt table assembly with it. One may also notice the drawing FIG. 27, the functionality of the tilt slits 320 to provide a clear space for the inner support rails 226.

Figure 24:
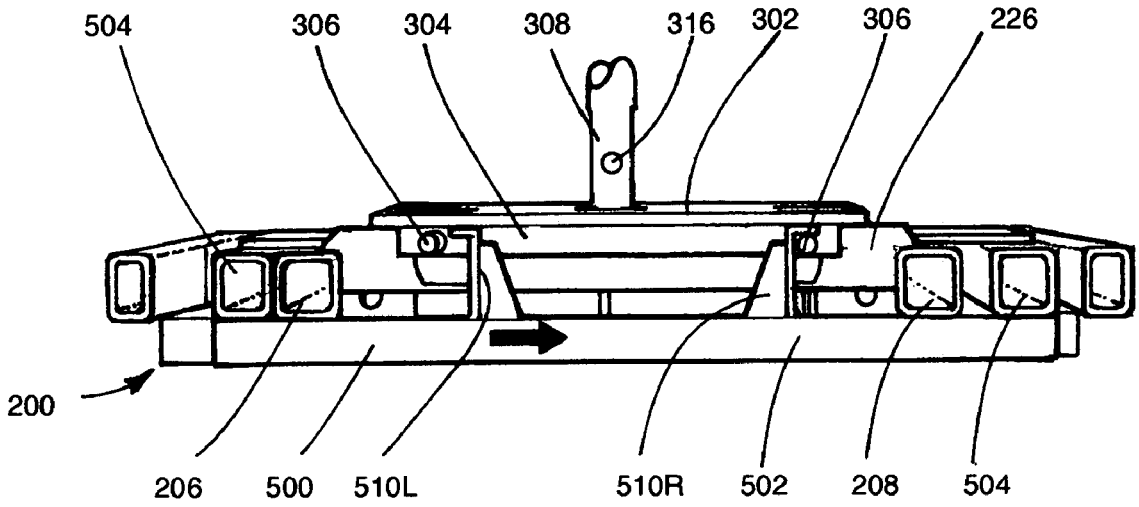
FIG. 24 is the fragmentary cross section view along line C-C of FIG. 21, showing the slide frame in a right position.
Figure 25:
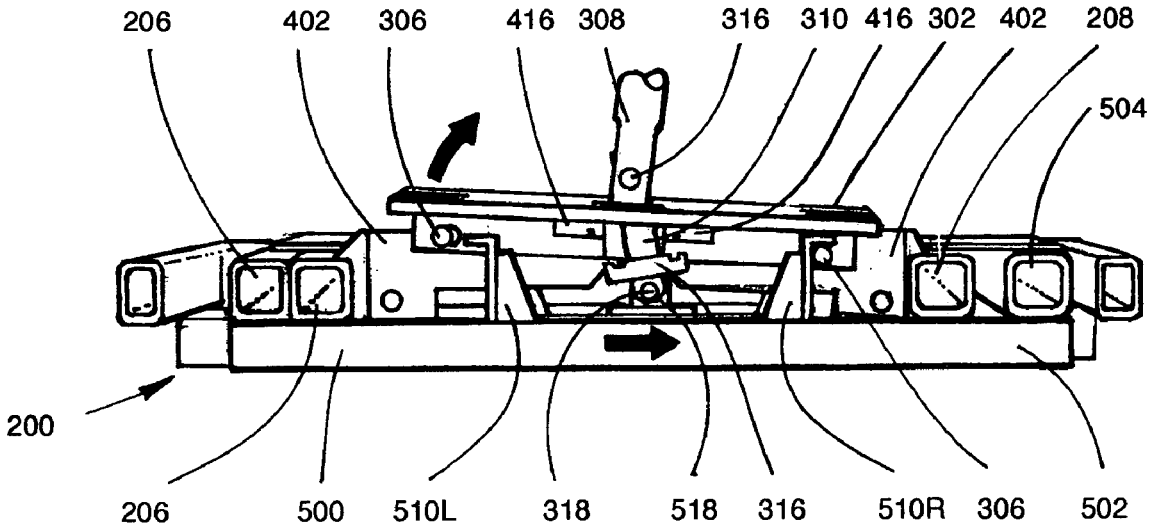
FIG. 25 is the view of FIG. 24 in further fragment, with the back inner support removed to show the toggle in a right position.

Alternatively, as is shown most clearly in the drawing FIGS. 24 and 25, the slide may be slid to its right position, in which the right hooks 51 OR capture and thereby lock the right table pivots 306 in their respective pivot seats 222 and 224 (FIG. 24). Concurrently, the left tilt stop 508L slides under the first end of the left tilt arm 400L to prevent that tilt arm from rotating about its pivot 408 from its folded position to its tilted position. On the other hand, the left table pivots are free to leave their respective pivot seats 222 and 224, and the right tilt stop 508R is clear of the right tilt arm 400R so that the right tilt arm is free to rotate about its pivot 408 from its folded position to its tilted position. Thus, with the slide 500 in its right position, activation of the tilt actuator 420 to draw together the respective first ends 402 of the left and the right tilt arms 400 rotates the right tilt arm to its tilted position and the tilt table assembly 300 with it (opposite to what is shown in FIG. 27).

Again, though conversely to movement of the slide to its left position, when the slide is moved to its right position, selecting the right tilt arm for actuation, the toggle switch 518 is engaged with the toggle tail 318 and manipulates the toggle 310 into its right position so that the right toggle catch hook 316 engages a corresponding catch block 416 at the second end 404 of the right tilt arm 400 (FIG. 25). With the toggle positioned to its right position, the second end of the right tilt arm is captured between the toggle and the tilt table plate 302 such that the tilt table assembly 300 will also not tip off from the right tilt arm. The tilt table assembly is again selectively captured by manipulation of the slide to follow the tilting and folding of the tilt arm. Of course, activation of the actuator 420 to spread apart the respective first ends of the left and the right tilt arms now rotates the right tilt arm to its folded position, and the tilt table assembly with it.

In a further aspect of the slide 500, one having ordinary skill in the art understands, upon comprehension of this disclosure, that means or mechanisms may be provided to lock the slide in each of its left and its right positions. One having ordinary skill in the art should further understand from this disclosure that a fencing handler of the invention may be constructed with a capacity to tilt the tilt table assembly 300 to only one of the left and the right sides, if desired.

In a further aspect of the toggle 310, a detent stop may be provided to releasably hold the toggle in each of its left and right positions (FIGS. 28 and 29). The detent is shown in the exemplary embodiment to include a ball bearing 324 that is spring biased with a helical coil spring 326 to ward the toggle. The detent is housed in an aperture through a block 330. A cooperating dimple 328 may be provided on a face of the toggle and the block fixed adjacent the toggle such that the ball engages the dimple when the toggle is toggled to one of its left and right positions. The same arrangement may preferably be provided with regard to the other of the toggle's left and right positions, with a second dimple 328.

Further as to the fencing guide tower 600 and the fencing tensioning clamp 700, the fencing guide tower may include at least one fencing material guide 602, while the clamp may include a clamp anvil 704, a clamp rail or bar 708, and a clamp actuator. With a single fencing material guide, a fencing handler of the invention is best suited to distributing fencing material in, say, a single direction, perhaps along only one side of a material handling tug 50. Thus, a pair of fencing material guides is more preferably provided so that the fencing handler may be ambidextrous, as it were, not singularly left handed or right handed.

The pair of fencing guides 602 is conveniently provided as a pair of substantially parallel, mild steel pipe segments that extend generally perpendicularly to the pallet 200 from the front edge 214 of the pallet. In keeping with the scale of the above description, the fencing guides may be about three inch (76.2 mm) standard mild steel pipe. The pair of fencing guides is also preferably centered along the front edge. Again with reference to a single handed fencing handler, a user may find in such a configuration that a single guide may most conveniently positioned at an end of the front edge, even at a trailing edge. Either way, a single guide or a pair of guides is easily braced with diagonal braces 606 extending between the foundation 200 and the fencing guide. The braces may be about two inch (50.8 mm) standard mild steel pipe or square tubing as shown.

Returning to the fencing tensioning clamp 700, the clamp anvil 704 may be constructed of two sections of about two inch (50.8 mm) standard mild steel pipe and more preferably of square tubing as shown (FIGS. 1-13, 30, and 31. The two sections are aligned diagonally and parallel relative to one another and oriented generally parallel with the fencing guide tower 600. Welding clips 706 may be used to secure the two sections in their respective diagonal alignment. The anvil extends generally perpendicular to and upward from the foundation 200 and is preferably fixed with the foundation at a bottom of the anvil and with the guide tower at a top of the anvil. Although, a free floating mounting of the anvil may be anticipated.

The clamp rail 708 may also be fabricated of a section of about two inch (50.8 mm) standard mild steel pipe and more preferably of square tubing as shown. The clamp rail is hingedly connected with the clamp anvil 704 to swing between a closed and open positions relative to the anvil. In the closed position, the clamp bar abuts the anvil and preferably nests between the two sections of the anvil. In the open position, the clamp bar is spaced away from the anvil.

The clamp actuator may be used to manipulate the clamp rail 708 between the open and the closed positions relative to the clamp anvil 704. Similar to the tilt actuator 420 above, the clamp actuator may be any of various extendable mechanisms, including hydraulic cylinders, pneumatic cylinders, screw jacks, and multiple link devices. In the example of the embodiment shown in the drawing, the clamp actuator includes a pair of double acting hydraulic cylinders 720 as is understood by one having ordinary skill in the art. One cylinder may be connected at the top of the anvil 704, between the anvil and the clamp rail 708. The other clamp cylinder may be connected at the base of the anvil, also between the anvil and the clamp rail. Arrangement is easily made to power the clamp actuator cylinders by connection with hydraulic power of the material handling tug 50 as is commonly known.

With clamping cylinders 720 located at opposite ends of the tensioning clamp 700, the inventor has found that bending the clamp rail 708 to be convex toward the anvil 704 is desirable. This may simply be arranged with a length of about ⅝ inch (15.9 mm) round stock 712 connected between the ends of the clamp rail on a side opposite to the anvil (FIG. 28). The round stock has a length that provides about 4-6 (101-153 mm) inches of space between it and the clamp bar 708 at an about mid point of the clamp. Further, a screw jack 714 may be arranged to extend between the clamp rail 708 and the round stock 712 such that extending the jack deflects the clamp rail into a desired convex curve toward the anvil. One having ordinary skill in the art will appreciate that a simple and effective screw jack may be configured with a bolt, a nut, and a length of pipe.

In yet another aspect of the invention, the fencing guide tower 600 and the fencing tensioning clamp 700 may be extendable (FIG. 32). Each of the guides 602 and the clamp anvil 704 may be fabricated in a modular construction in which their respective top fittings and fixtures, including, 622 and 722, respectively, may be detached and a length insert 624 and 724, respectively, may be inserted to extend their respective lengths. As shown in the drawing, what is commonly known as a "tenon and mortise" or a "pin and socket" joint may easily be implemented for this purpose. The clamp may also be extended in like manner, although one who uses the invention may find that merely providing a longer clamp assembly is the simpler solution.

More specifically, the top portions 622 of the guide and the top portions 722 of the clamp may preferably be interconnected with a top plate 620. This is a preferred selection of two of the guide 600, the anvil 704, and the rail 708 because the rail is more preferably made non-extendable as just commented. The third of the guide, the anvil, and the rail, namely, the rail in this example, then serves to interconnect the top plate with the foundation 200 such that the guide and the anvil and their respective extensions 624 and 724, respectively, and the top plate are fastened together by the rail 708.

In use, the fencing handler 100 is easily coupled with a material handling tug 50 by maneuvering the load forks under the pallet 200, and specifically, engaging the transverse beams 202 and 204. The beams may be engaged from the right as shown (FIGS. 1-3) with the front 214 of the fencing handler foundation extending to a right side of the tug. Alternatively, the beams may be engaged from the left with the front of the fencing handler foundation extending to a left side of the tug. It should be appreciated that the transverse foundation beams 202 and 204 are set toward the back of the fencing handler so that the front of the fencing handler, and specifically the guide tower 600 is positioned along and spaced from the respective side of the tug. This positioning of the guide tower facilitates running fencing down the tug side and minimizing interference and entanglement of the fencing with the tug.

The pallet 200 may be conveniently lashed or otherwise secured to the respective tug 50 as is known. The hydraulic actuating cylinders 420 and 720, if used, may be connected with hydraulic power from the tug as is also known. So connected, the fencing handler 100 may be maneuvered by the tug just as any load that is secured on the load forks. More specifically as to the slide 500, the slide is preferably slid to its left position (FIGS. 22 and 23) when the transverse beams 202 and 204 are engaged from the right of the foundation 200, so that the spool post 308 may tilt to the left of the foundation and away from the tug. The slide is conversely slid to its right position when the transverse beams are engaged from the left of the foundation, so that the spool post may tilt to the right of the foundation, again away from the tug.

With the fencing handler 100 so installed on a selected tug 50, activation of the tilt table actuator 420 may be controlled through manipulation of the tug hydraulic power to tilt the tilt table assembly 300 and the spool post 308 to a generally horizontal orientation. Alternatively, the tilt table assembly and the spool post may be manipulated to extend the post generally vertically upward, generally perpendicular to the foundation 200. With the post tilted generally horizontally, rolls of fencing may be easily acquired and positioned on the spool post or removed therefrom (FIGS. 3-5).

Figures 3, 4, 5:
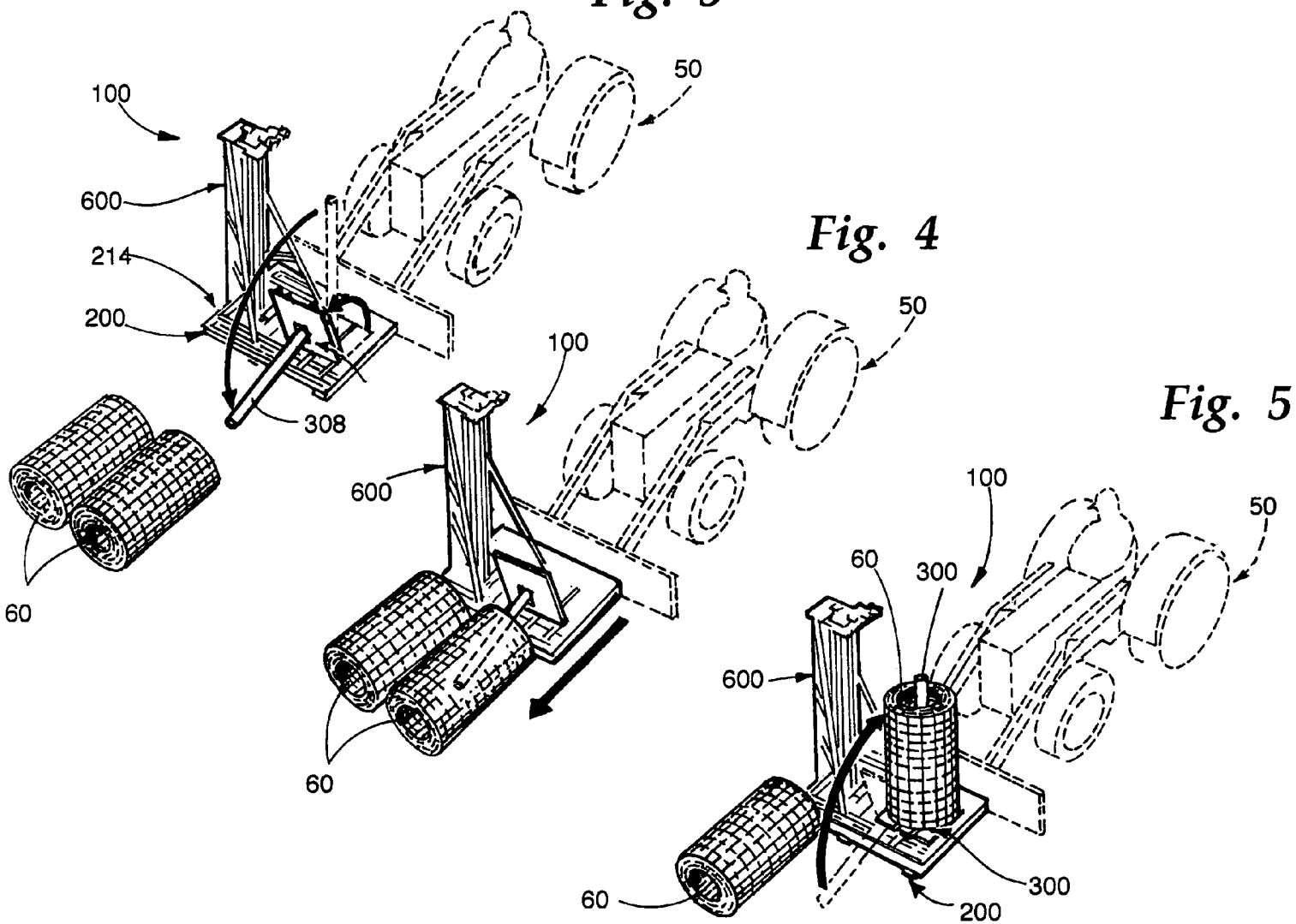
FIG. 3 is the view of FIG. 2, showing a spool post of the fencing handler tilted forward into a horizontal position to acquire a roll of fencing.
FIG. 4 is the view of FIG. 3, showing acquisition of a roll of fencing.
FIG. 5 is the view of FIG. 4, showing the spool post tilted upward to a vertical position with an acquired a roll of fencing.
Figure 6:
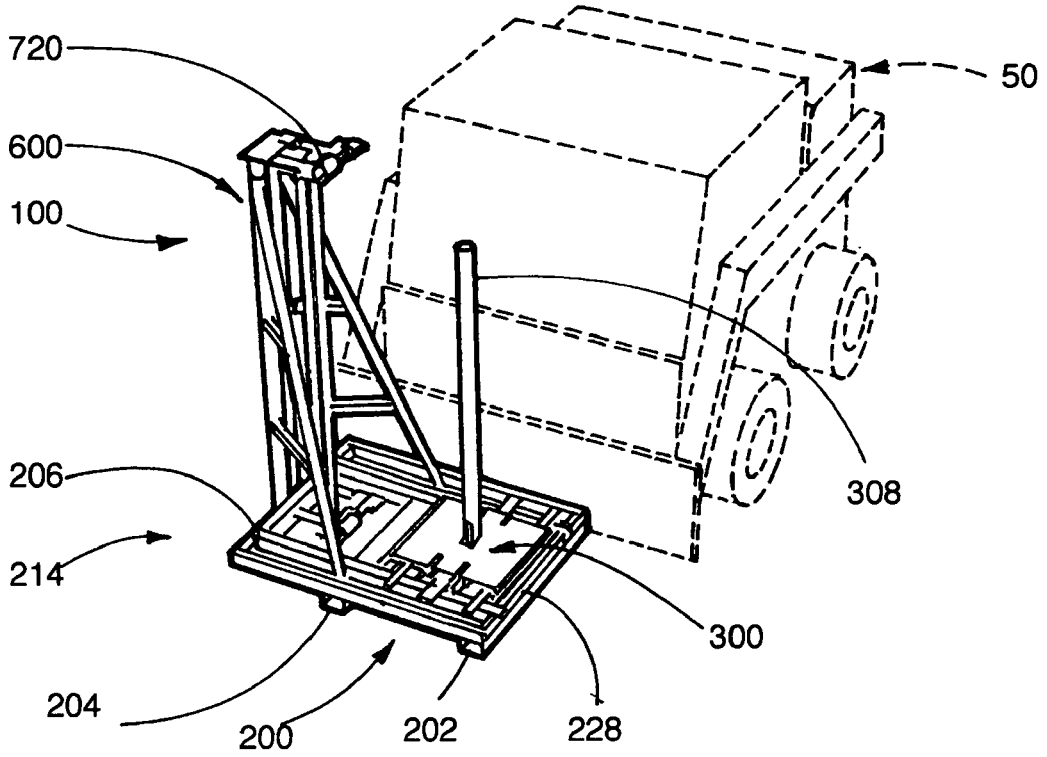
FIG. 6 is another upper back left perspective view thereof, showing a skid-steer to handle the tool in phantom.
Figure 7:
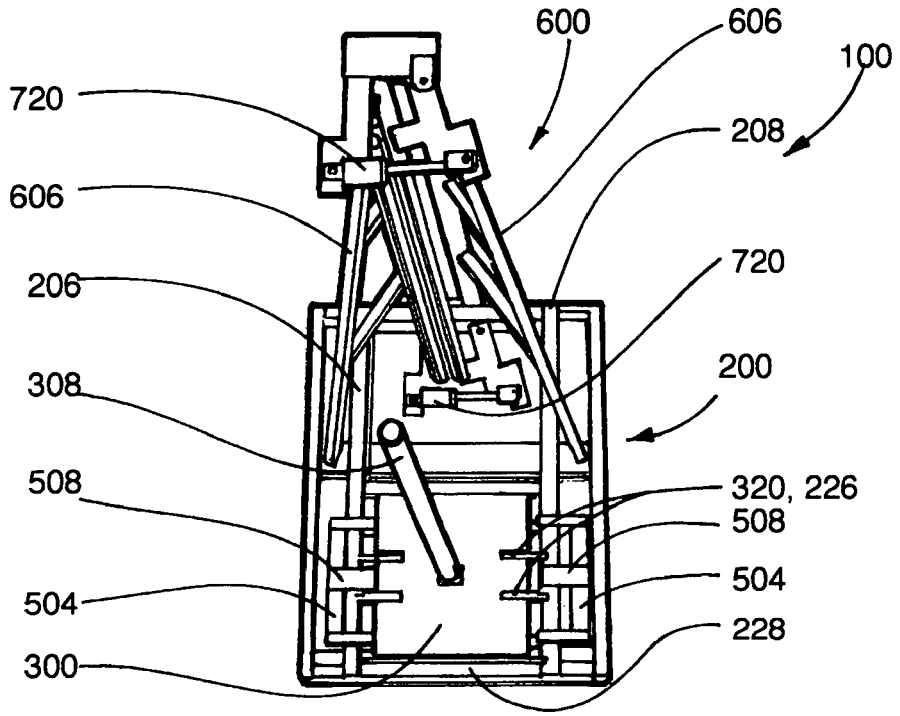
FIG. 7 is an upper back perspective view of the inventive tool.
Figure 8:
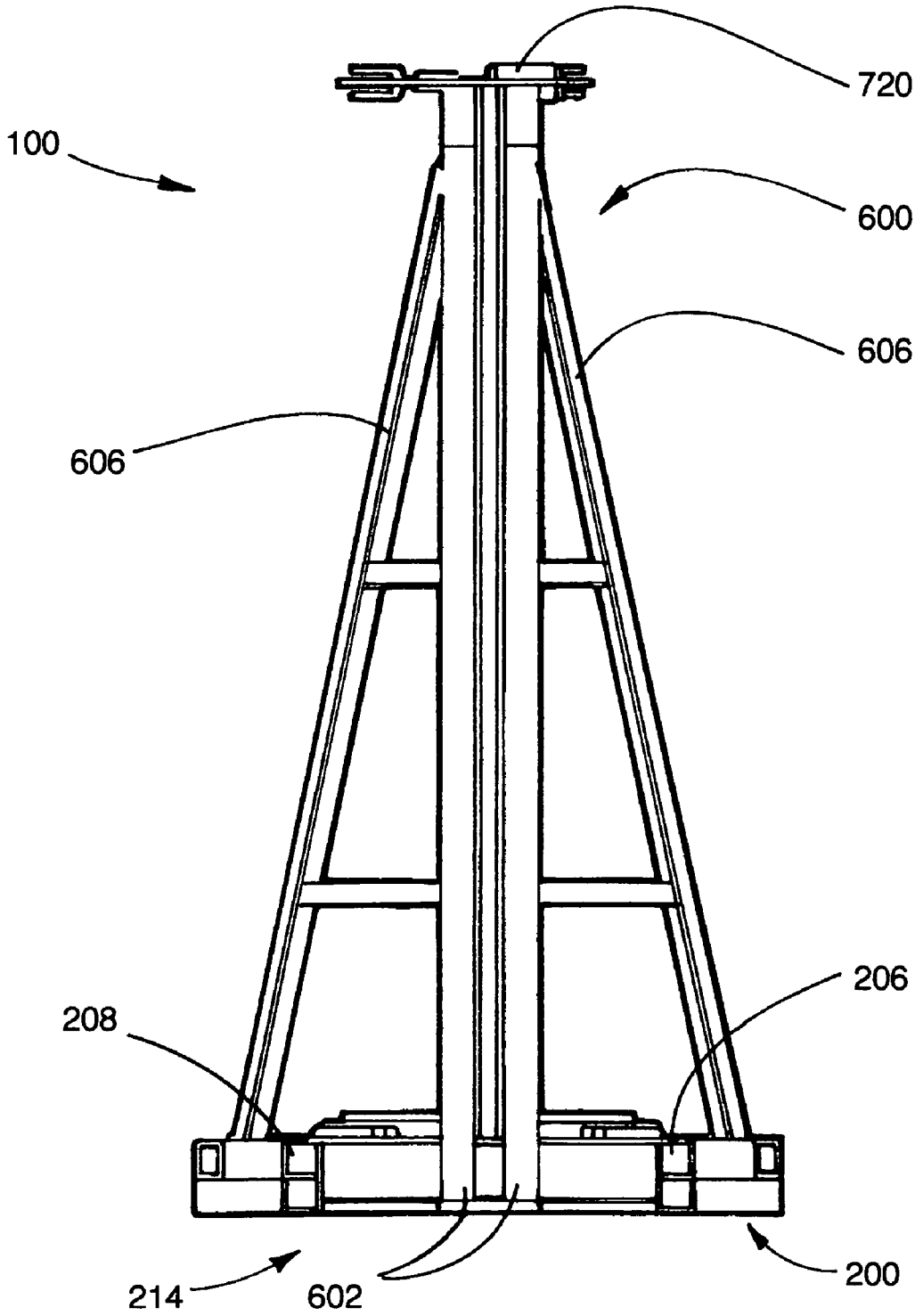
FIG. 8 is a front elevation view thereof.
Figure 9:
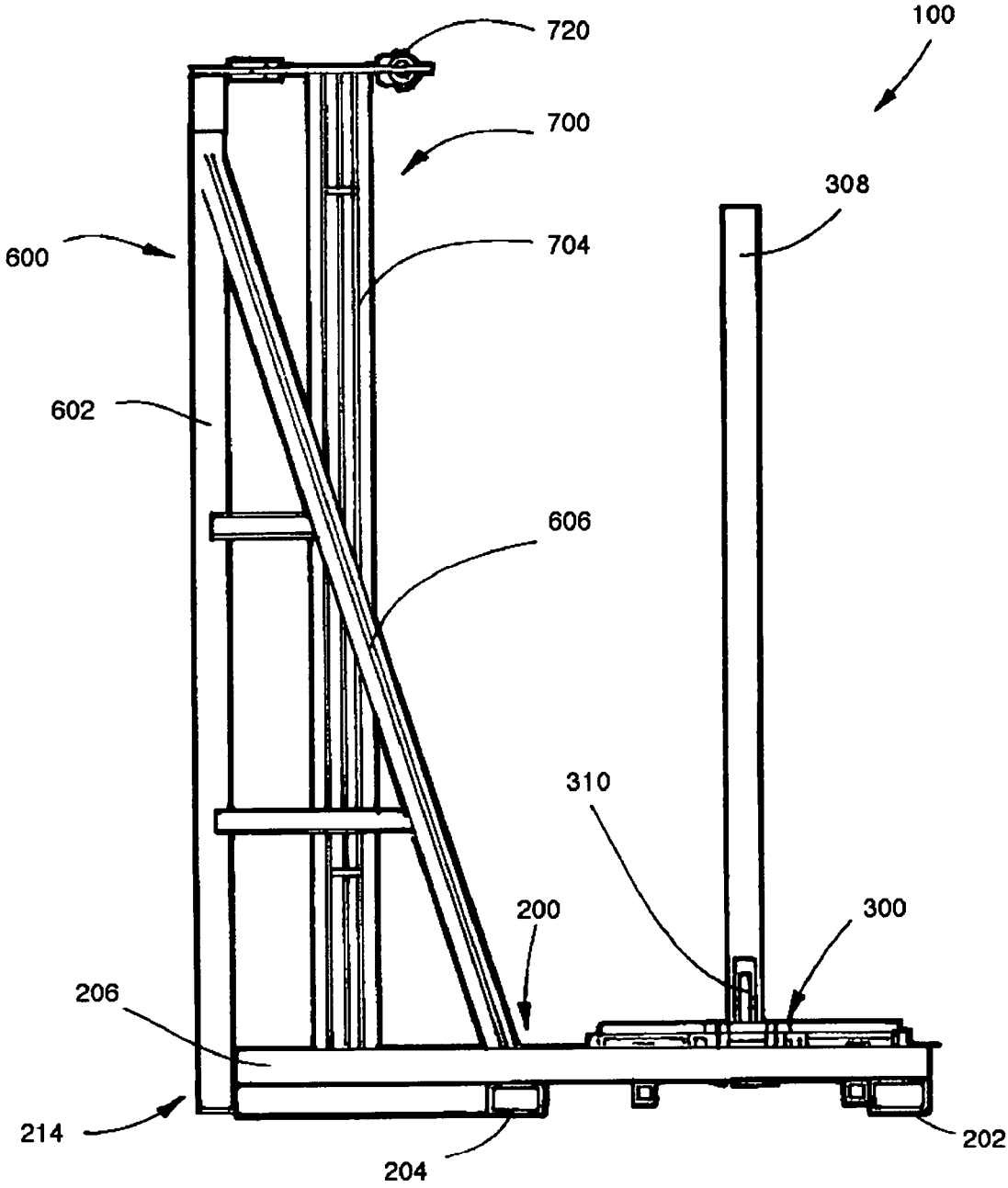
FIG. 9 is a left side elevation view thereof.
Figure 10:
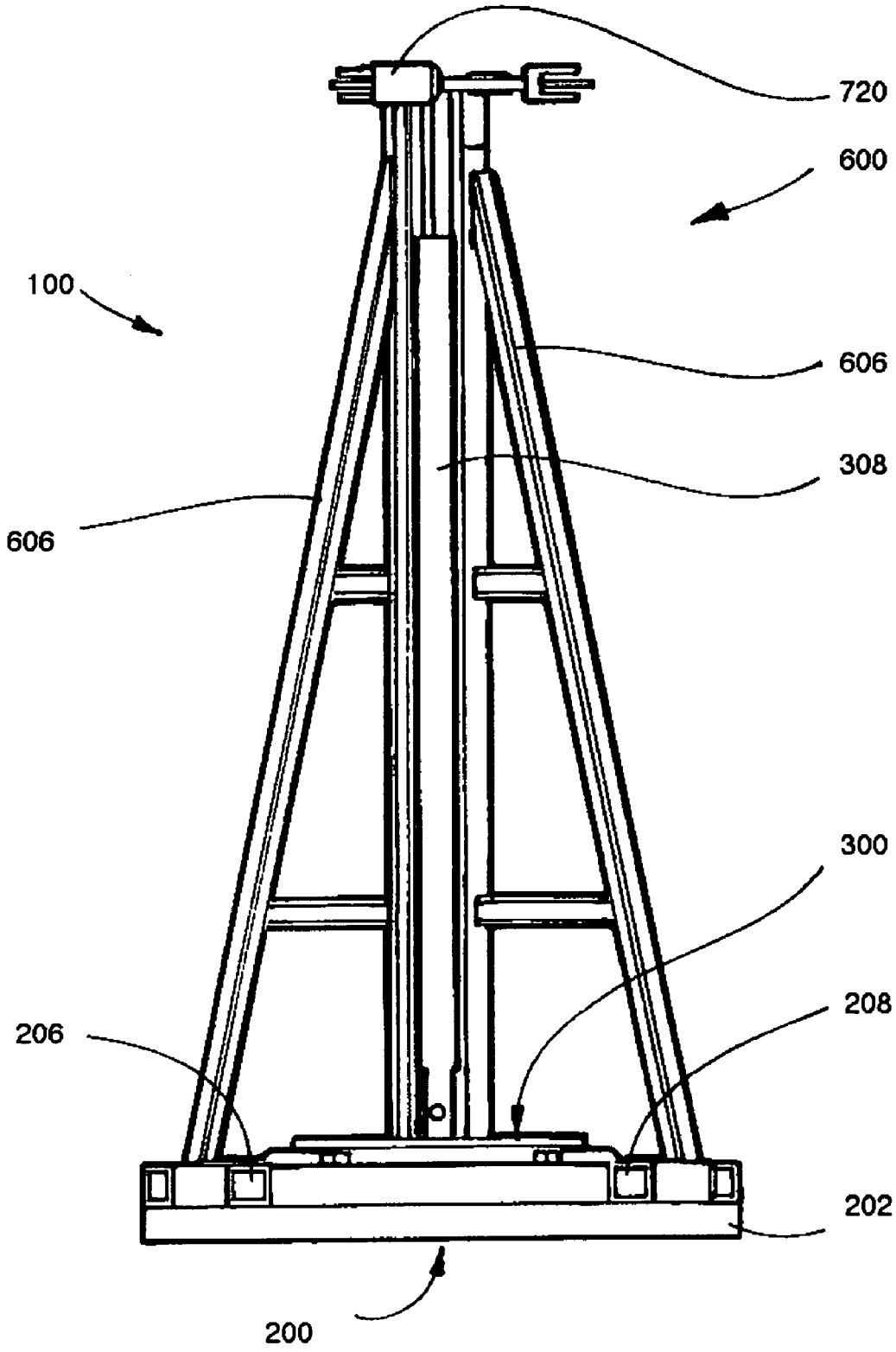
FIG. 10 is a back elevation view thereof.
Figure 11:
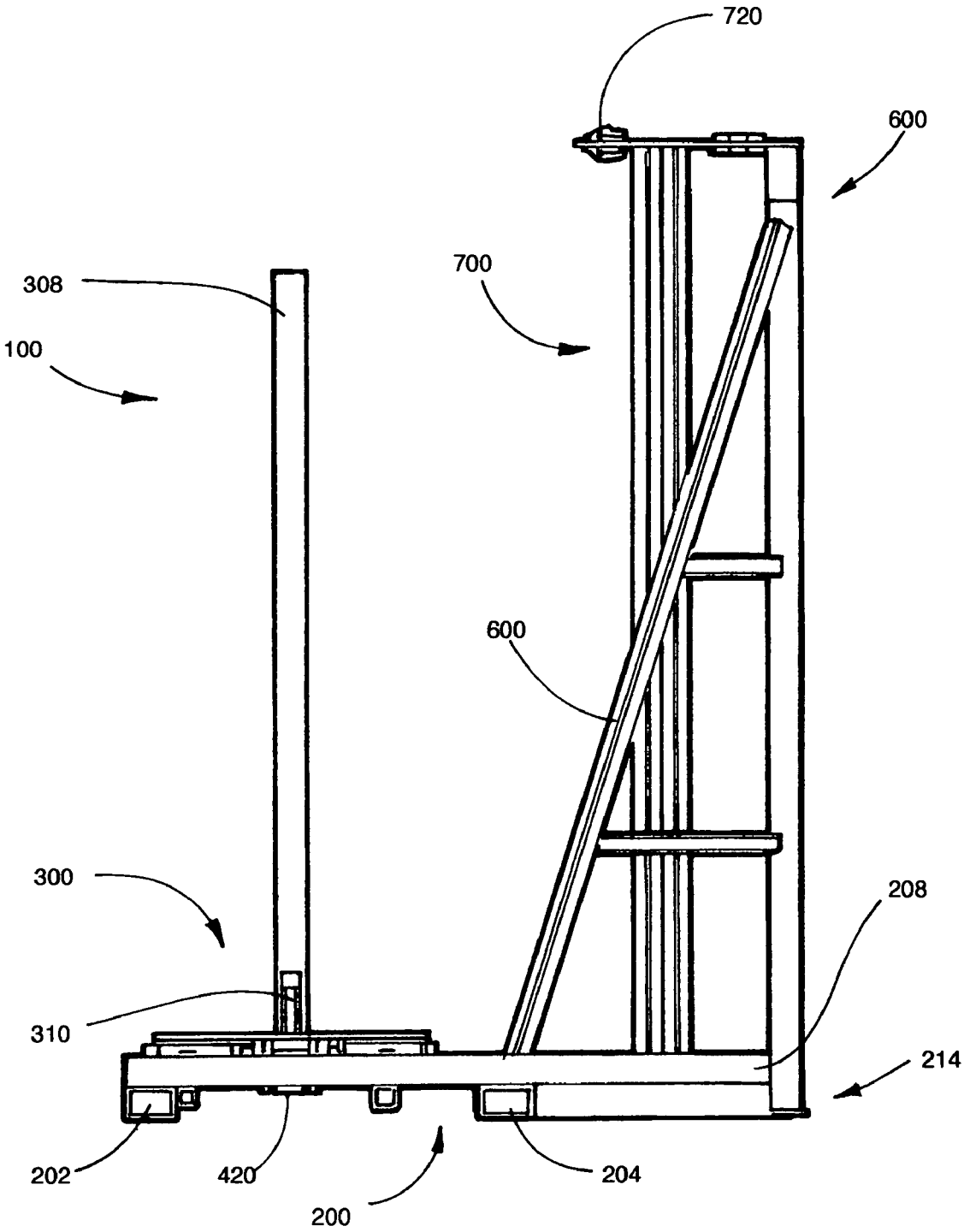
FIG. 11 is a right side elevation view thereof.
Figure 12:
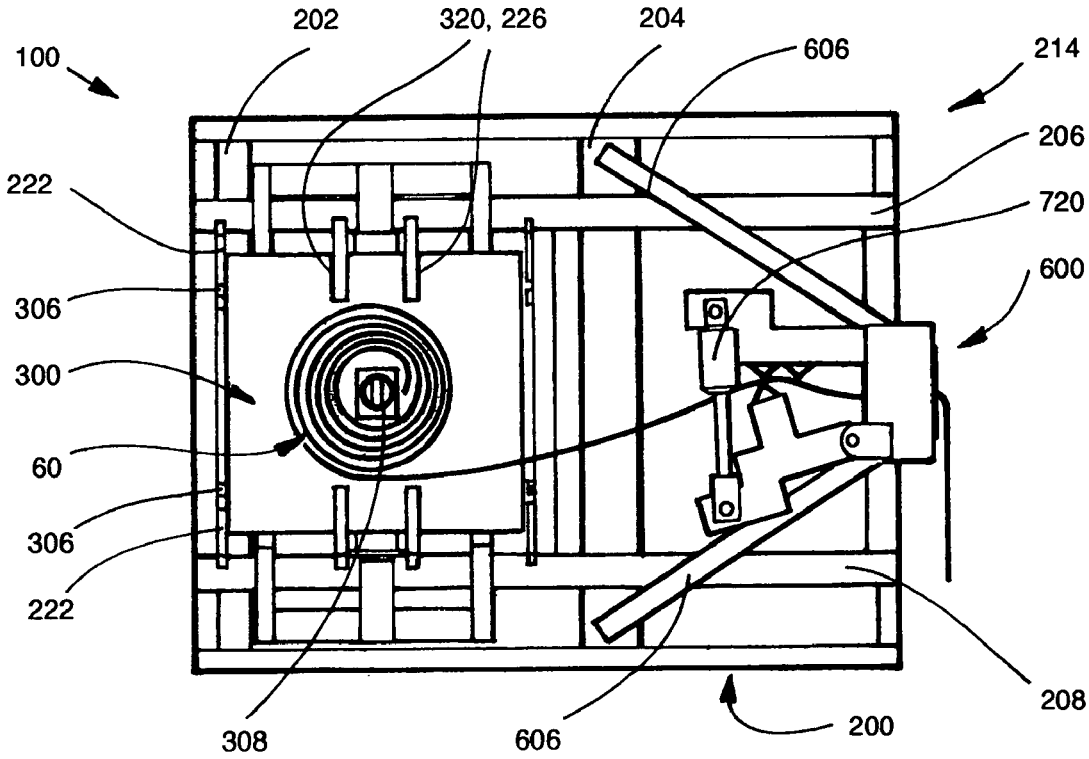
FIG. 12 is top plan view thereof.
Figure 30:
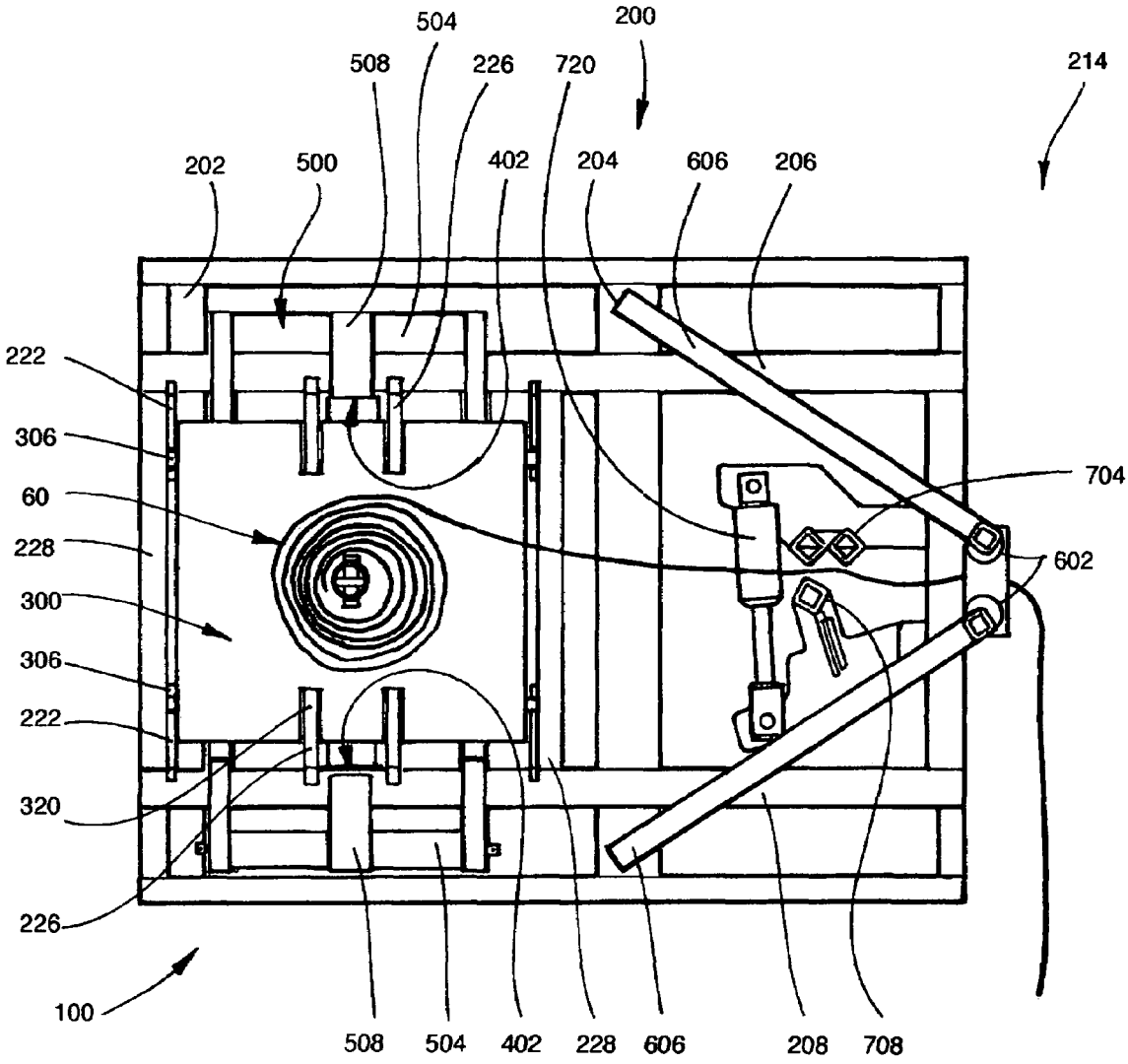
FIG. 30 is the top plan view of FIG. 12 with the top plate and top actuator thereof removed for clarity.
Figure 31:
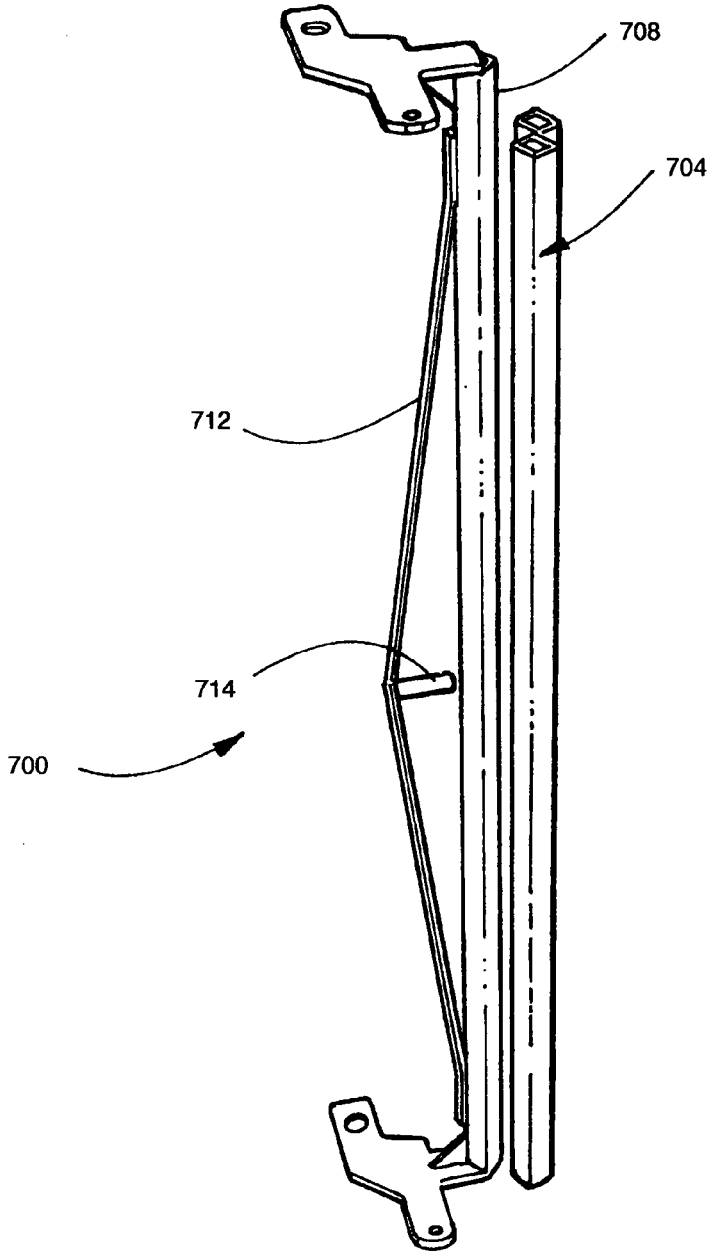
FIG. 31 is a fragmentary upper front left perspective view of a tensioning clamp of a fencing handler of the invention.

The spool post 308 will most commonly be generally vertically oriented and often with a roll of fencing material 60 set upon the tilt table 302 (FIG. 5). With the tensioning clamp 700 in its open position, a free end of the roll of fencing may be feed through the tensioning clamp, between the clamp bar 708 and the anvil 704 (FIGS. 12 and 30).

As noted above, fence erection commonly includes a process of installing an array of fence posts with subsequent placement of a fencing material along the posts and attachment of the fencing material to the posts. With a free end of a roll of fencing material routed through the tensioning clamp and the guide tower, the end of the fencing may further be routed to a preinstalled fence post and connected with the post. Placement of the fencing material is then mostly a matter of driving the tug along the installed fence posts so that the fencing material is positioned adjacent the posts. The fencing material will spool off of its roll, rotating about the spool post 308. Position of the fencing material may be controlled by an operator controlling elevation and orientation of the load forks.

Of course, the fencing roll will not rotate freely and, rather, will somewhat resist its dispensing as it skids in rotation on the tilt table plate 302. This provides a desired tension of the fencing material. Further tensioning of the fencing may be had by closing the tensioning clamp against the fencing material. By control of the extent to which the clamp is moved from its open toward its closed position, an operator may control an amount of tension that is imparted to the fencing material, to an upper limit at which the fencing no longer passes through the clamp.

One having ordinary skill in the art and those who practice the invention understand from this disclosure that while the technology of the present invention may not be "rocket science" and may not depend on relatively close tolerances, this invention is a clever application of mechanics that anticipates various modifications and improvements, which modifications and improvements may be made without departing from the spirit of the disclosed inventive concept. The one also understands that various relational terms, including left, right, front, back, top, and bottom, for example, may be used in this detailed description of the invention and in the claims only to convey relative positioning of various elements of the claimed invention without limitation to the invention.

What is claimed is:

1. A fencing handler, comprising:

a foundation with a front, a back opposite the front, a left side, a right side opposite the left, and a top;

a spool post connected with the foundation, the spool post being adapted to tilt relative to the foundation so that the spool post may be manipulated to tilt to the left side of the foundation and to tilt to the right side of the foundation and may stand between the left and the right tilted positions to extend upward, generally perpendicular to the foundation;

a tilt arm hingedly connected with the foundation to hinge between a folded position and a tilted position, the tilt arm extending from a first end to a second end and being oriented such that the tilt arm extends between the foundation left and right sides in the folded position;

a tilt arm pivot connected between the foundation and the tilt arm, the tilt arm pivot being connected with the tilt arm between the first and the second tilt arm ends and having a pivot axis that extends between the foundation front and back so that the tilt arm is pivotable about the tilt arm pivot and toward one of the foundation left and right sides to its tilted position;

a tilt actuator connected between the first tilt arm end and the foundation, the actuator extending along the tilt arm and being adapted to rotate the tilt arm about the tilt arm pivot between the folded and tilted positions;

a tilt plate releasably connected with the foundation and adapted to hinge with the tilt arm between the folded and the tilted positions; and a toggle pivotally connected with the tilt plate whereby the tilt arm second end is captured between the toggle and the tilt plate and alternatively released.

2. The fencing handler of claim 1 further including a slide that is releasably coupled with the foundation and adapted to slide relative to the foundation between a left position in which the slide has been slid to the foundation left and a right position in which the slide has been slid to the foundation right, the slide also being releasably coupled with the toggle whereby the toggle is manipulated between capturing and releasing the tilt arm second end when the slide is in its left and right positions, respectively.

3. The fencing handler of claim 2 wherein the tilt table includes a table pivot that extends coaxially along the axis of the tilt arm pivot and about which the table tilts with the tilt arm.

4. The fencing handler of claim 3 wherein the foundation has a cooperating table pivot seat into which the table pivot is removably seated.

5. The fencing handler of claim 4 wherein the slide further includes a table pivot lock that captures the table pivot in the table pivot seat when the slide is in its left position.

6. The fencing handler of claim 5, wherein the tilt arm and the tilt arm pivot are a first tilt arm pivot and a first tilt arm that pivots from its folded position toward the foundation left side to its tilted position, and wherein the fencing handler further includes a second tilt arm pivot and a second tilt arm hingedly connected with the foundation in mirror image relation to the first tilt arm whereby the second tilt arm hinges between a folded position and a tilted position, pivoting from its folded position toward the foundation right side to its tilted position.

7. The fencing handler of claim 6 wherein the toggle toggles between a position in which the first tilt arm is captured between the toggle and the tilt plate while the second tilt arm is released, and a position in which the second tilt arm is captured between the toggle and the tilt plate while the first tilt arm is released.

8. The fencing handler of claim 1, wherein the tilt arm and the tilt arm pivot are a first tilt arm pivot and a first tilt arm that pivots from its folded position toward the foundation left side to its tilted position, and wherein the fencing handler further includes a second tilt arm pivot and a second tilt arm hingedly connected with the foundation in mirror image relation to the first tilt arm whereby the second tilt arm hinges between a folded position and a tilted position, pivoting from its folded position toward the foundation right side to its tilted position.

9. The fencing handler of claim 1 further including a fencing material guide near the front, and a fencing material tensioning clamp, the clamp having a clamp anvil and a clamp rail that clampingly engages the clamp anvil, and wherein two members of a group comprising the guide, the anvil, and the rail include a length extending insert and are interconnected with a top plate, wherein the remaining one member of the group comprising the guide, the anvil, and the rail is a fixed length elongated member that interconnects between the top plate and the foundation such that the two of the guide, the anvil, and the rail, their respective extensions, and the top plate are fastened together by the remaining one of the guide, the anvil, and the rail.

10. The fencing handler of claim 1 further including a tensioning clamp mechanism with an anvil and a cooperating clamp rail that is hingedly connected with the anvil to hinge between open and closed positions, whereby fencing material is routed between the anvil and the clam rail and is releasably clamped there between.

11. In a fencing handler that has a foundation with a front, a back opposite the front, a left side, a right side opposite the left, and a top, and which foundation is adapted to couple with and be handled by a vehicle, including a truck, a skid steer, and a tractor, the improvement of a tilting spool post, comprising:

a tilt arm hingedly connected with the foundation to hinge between a folded position and a tilted position, the tilt arm extending from a first end to a second end and being oriented such that the tilt arm extends between the foundation left and right sides in the folded position;

a tilt arm pivot connected between the foundation and the tilt arm, the tilt arm pivot being connected with the tilt arm between the first and the second tilt arm ends and having a pivot axis that extends between the foundation front and back so that the tilt arm is pivotable about the tilt arm pivot and toward one of the foundation left and right sides to its tilted position;

a tilt actuator connected between the first tilt arm end and the foundation, the actuator extending along the tilt arm and being adapted to rotate the tilt arm about the tilt arm pivot between the folded and tilted positions;

a tilt plate releasably connected with the foundation and adapted to hinge with the tilt arm between the folded and the tilted positions;

a spool post connected with the tilt plate whereby the spool post tilts with the tilt plate; and a toggle pivotally connected with the tilt plate whereby the tilt arm second end is optionally captured between the toggle and the tilt plate and released.

12. The fencing handler of claim 11 further including a slide that is releasably coupled with the foundation and adapted to slide relative to the foundation between a left position in which the slide has been slid to the foundation left and a right position in which the slide has been slid to the foundation right, the slide also being releasably coupled with the toggle whereby the toggle is manipulated between capturing and releasing the tilt arm second end when the slide is in its left and right positions, respectively.

13. The fencing handler of claim 12 wherein the tilt table includes a table pivot that extends coaxially along the axis of the tilt arm pivot and about which the table tilts with the tilt arm.

14. The fencing handler of claim 13 wherein the foundation has a cooperating table pivot seat into which the table pivot is removably seated.

15. The fencing handler of claim 14 wherein the slide further includes a table pivot lock that captures the table pivot in the table pivot seat when the slide is in its left position.

16. The fencing handler of claim 15, wherein the tilt arm and the tilt arm pivot are a first tilt arm pivot and a first tilt arm that pivots from its folded position toward the foundation left side to its tilted position, and wherein the fencing handler further includes a second tilt arm pivot and a second tilt arm hingedly connected with the foundation in mirror image relation to the first tilt arm whereby the second tilt arm hinges between a folded position and a tilted position, pivoting from its folded position toward the foundation right side to its tilted position.

17. The fencing handler of claim 16 wherein the toggle toggles between a position in which the first tilt arm is captured between the toggle and the tilt plate while the second tilt arm is released, and a position in which the second tilt arm is captured between the toggle and the tilt plate while the first tilt arm is released.

18. The fencing handler of claim 11, wherein the tilt arm and the tilt arm pivot are a first tilt arm pivot and a first tilt arm that pivots from its folded position toward the foundation left side to its tilted position, and wherein the fencing handler further includes a second tilt arm pivot and a second tilt anti hingedly connected with the foundation in mirror image relation to the first tilt arm whereby the second tilt arm hinges between a folded position and a tilted position, pivoting from its folded position toward the foundation right side to its tilted position.

19. The fencing handler of claim 11 further including a fencing material guide near the front, and a fencing material tensioning clamp, the clamp having a clamp anvil and a clamp rail that clampingly engages the clamp anvil, and wherein two members of a group comprising the guide, the anvil, and the rail include a length extending insert and are interconnected with a top plate, wherein the remaining one member of the group comprising the guide, the anvil, and the rail is a fixed length elongated member that interconnects between the top plate and the foundation such that the two of the guide, the anvil, and the rail, their respective extensions, and the top plate are fastened together by the remaining one of the guide, the anvil, and the rail.

20. The fencing handler of claim 11 further including a tensioning clamp mechanism with an anvil and a cooperating clamp rail that is hingedly connected with the anvil to hinge between open and closed positions, whereby fencing material is routed between the anvil and the clam rail and is releasably clamped there between.

21. A fencing handler, comprising:

a foundation with a front, a back opposite the front, a left side, a right side opposite the left, and a top;

a tilt arm hingedly connected with the foundation to hinge between a folded position and a tilted position, the tilt arm extending from a first end to a second end and being oriented such that the tilt arm extends between the foundation left and right sides in the folded position;

a tilt arm pivot connected between the foundation and the tilt arm, the tilt arm pivot being connected with the tilt arm between the first and the second tilt arm ends and having a pivot axis that extends between the foundation front and back so that the tilt arm is pivotable about the tilt arm pivot and toward one of the foundation left and right sides to its tilted position;

a tilt actuator connected between the first tilt arm end and the foundation, the actuator extending along the tilt arm and being adapted to rotate the tilt arm about the tilt arm pivot between the folded and tilted positions;

a tilt plate releasably connected with the foundation and adapted to hinge with the tilt arm between the folded and the tilted positions;

a spool post connected with the tilt plate whereby the spool post tilts with the tilt plate; and a toggle pivotally connected with the tilt plate whereby the tilt arm second end is optionally captured between the toggle and the tilt plate and released.

22. The fencing handler of claim 21 further including a slide that is releasably coupled with the foundation and adapted to slide relative to the foundation between a left position in which the slide has been slid to the foundation left and a right position in which the slide has been slid to the foundation right, the slide also being releasably coupled with the toggle whereby the toggle is manipulated between capturing and releasing the tilt arm second end when the slide is in its left and right positions, respectively.

23. The fencing handler of claim 22 wherein the tilt table includes a table pivot that extends coaxially along the axis of the tilt arm pivot and about which the table tilts with the tilt arm.

24. The fencing handler of claim 23 wherein the foundation has a cooperating table pivot seat into which the table pivot is removably seated.

25. The fencing handler of claim 24 wherein the slide further includes a table pivot lock that captures the table pivot in the table pivot seat when the slide is in its left position.

26. The fencing handler of claim 25, wherein the tilt arm and the tilt arm pivot are a first tilt arm pivot and a first tilt arm that pivots from its folded position toward the foundation left side to its tilted position, and wherein the fencing handler further includes a second tilt arm pivot and a second tilt arm hingedly connected with the foundation in mirror image relation to the first tilt arm whereby the second tilt arm hinges between a folded position and a tilted position, pivoting from its folded position toward the foundation right side to its tilted position.

27. The fencing handler of claim 26 wherein the toggle toggles between a position in which the first tilt arm is captured between the toggle and the tilt plate while the second tilt arm is released, and a position in which the second tilt arm is captured between the toggle and the tilt plate while the first tilt arm is released.

28. The fencing handler of claim 21, wherein the tilt arm and the tilt arm pivot are a first tilt arm pivot and a first tilt arm that pivots from its folded position toward the foundation left side to its tilted position, and wherein the fencing handler further includes a second tilt arm pivot and a second tilt arm hingedly connected with the foundation in mirror image relation to the first tilt arm whereby the second tilt arm hinges between a folded position and a tilted position, pivoting from its folded position toward the foundation right side to its tilted position.

29. The fencing handler of claim 21 further including a fencing material guide near the front, and a fencing material tensioning clamp, the clamp having a clamp anvil and a clamp rail that clampingly engages the clamp anvil, and wherein two members of a group comprising the guide, the anvil, and the rail include a length extending insert and are interconnected with a top plate, wherein the remaining one member of the group comprising the guide, the anvil, and the rail is a fixed length elongated member that interconnects between the top plate and the foundation such that the two of the guide, the anvil, and the rail, their respective extensions, and the top plate are fastened together by the remaining one of the guide, the anvil, and the rail.

30. The fencing handler of claim 21 further including a tensioning clamp mechanism with an anvil and a cooperating clamp rail that is hingedly connected with the anvil to hinge between open and closed positions, whereby fencing material is routed between the anvil and the clam rail and is releasably clamped there between.

31. In a fencing handler that has a foundation with a front, the foundation being adapted to couple with and be handled by a material handler tug, that has a fencing material guide near the front, and that has a fencing material tensioning clamp, including a clamp anvil and a clamp rail that clampingly engages the clamp anvil, the improvement of a combination of the fencing material guide and the fencing material tensioning clamp being adapted to adjust in length, wherein two members of a group comprising the guide, the anvil, and the rail include a length extending insert and are interconnected with a top plate, and wherein the remaining one member of the group comprising the guide, the anvil, and the rail is a fixed length elongated member that interconnects between the top plate and the foundation such that the two of the guide, the anvil, and the rail, their respective extensions, and the top plate are fastened together by the remaining one of the guide, the anvil, and the rail.

* * * * *